US010037001B2

(12) United States Patent
Sato

(10) Patent No.: US 10,037,001 B2
(45) **Date of Patent: *Jul. 31, 2018**

(54) IMAGE FORMING APPARATUS COMPRISING PROCESS CARTRIDGE

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/583,207

(22) Filed: May 1, 2017

(65) Prior Publication Data

US 2017/0235275 A1 Aug. 17, 2017

Related U.S. Application Data

(63) Continuation of application No. 15/016,646, filed on Feb. 5, 2016, now Pat. No. 9,639,055.

(30) Foreign Application Priority Data

Feb. 6, 2015 (JP) ..... 2015-022599

(51) Int. Cl.
*G03G 15/00* (2006.01)
*G03G 21/18* (2006.01)

(52) U.S. Cl.
CPC ..... *G03G 21/1842* (2013.01); *G03G 21/18* (2013.01); *G03G 21/185* (2013.01); *G03G 21/1846* (2013.01); *G03G 21/1853* (2013.01)

(58) Field of Classification Search
CPC ..... G03G 21/1842; G03G 21/18; G03G 21/1846; G03G 21/185; G03G 21/1853
See application file for complete search history.

(56) References Cited

U.S. PATENT DOCUMENTS 5,065,197 A 11/1991 Mitsuyama
5,225,881 A 7/1993 Goto et al.
(Continued)

FOREIGN PATENT DOCUMENTS

JP S63-8653 A 1/1988
JP H0836346 A 2/1996
(Continued)

OTHER PUBLICATIONS

Feb. 5, 2016—Co-pending U.S. Appl. No. 15/016,638.
(Continued)

*Primary Examiner* — David M Gray
*Assistant Examiner* — Michael Harrison
(74) *Attorney, Agent, or Firm* — Banner & Witcoff, Ltd.

(57) ABSTRACT

An image forming apparatus includes a body casing, a plurality of process cartridges, and a moving member. Each process cartridge includes a photosensitive drum having a rotation axis extending in a first direction. The plurality of process cartridges is configured to move between an engaging position and a release position in a second direction perpendicular to the first direction. The photosensitive drum and the positioning member engage with each other in the engaging position, and are disengaged from each other releasing the engagement in the release position. The moving member in a pressing position is configured to exert pressure so that the process cartridges are moved to the engaging position. The moving member in the non-pressing position is configured to release the pressure so that the process cartridges are moved to the release position.

19 Claims, 12 Drawing Sheets

(56) References Cited

U.S. PATENT DOCUMENTS

| | | | | |
|---|---|---|---|---|
| 6,587,660 | B2 | 7/2003 | Ueno et al. | |
| 7,486,907 | B2 | 2/2009 | Noguchi et al. | |
| 7,660,549 | B2 | 2/2010 | Noguchi et al. | |
| 7,664,428 | B2 | 2/2010 | Kei | |
| 7,684,728 | B2 | 3/2010 | Okabe et al. | |
| 8,145,095 | B2 | 3/2012 | Sakurai et al. | |
| 8,358,952 | B2 | 1/2013 | Okabe | |
| 8,447,208 | B2 | 5/2013 | Fujita et al. | |
| 8,606,143 | B2 | 12/2013 | Kikuchi | |
| 8,712,282 | B2 | 4/2014 | Sato | |
| 8,755,718 | B2 | 6/2014 | Ushiozu et al. | |
| 8,768,206 | B2 | 7/2014 | Sato | |
| 8,792,805 | B2 | 7/2014 | Takayama | |
| 8,855,530 | B2 | 10/2014 | Sato | |
| 8,862,022 | B2 | 10/2014 | Sato et al. | |
| 8,892,002 | B2 | 11/2014 | Sato | |
| 8,929,770 | B2 | 1/2015 | Sato | |
| 8,948,656 | B2 | 2/2015 | Nakano | |
| 9,037,036 | B2 | 5/2015 | Yamashita et al. | |
| 9,052,688 | B2 | 6/2015 | Sekido | |
| 9,128,459 | B2 | 9/2015 | Souda | |
| 9,134,686 | B2 | 9/2015 | Yoshikawa et al. | |
| 9,134,695 | B2 | 9/2015 | Furukawa et al. | |
| 9,146,492 | B2 | 9/2015 | Suzuki | |
| 2007/0077087 | A1 | 4/2007 | Okabe et al. | |
| 2007/0160385 | A1 | 7/2007 | Noguchi et al. | |
| 2008/0159774 | A1 | 7/2008 | Tanabe et al. | |
| 2009/0047039 | A1 | 2/2009 | Noguchi et al. | |
| 2009/0092412 | A1* | 4/2009 | Kei | G03G 21/1853 399/110 |
| 2009/0116869 | A1 | 5/2009 | Kotsuka et al. | |
| 2009/0169252 | A1 | 7/2009 | Sato | |
| 2009/0290903 | A1 | 11/2009 | Horikawa et al. | |
| 2009/0290904 | A1 | 11/2009 | Kawai et al. | |
| 2009/0290905 | A1 | 11/2009 | Mizuno et al. | |
| 2009/0324275 | A1 | 12/2009 | Okabe | |
| 2010/0080615 | A1 | 4/2010 | Kikuchi | |
| 2010/0080619 | A1 | 4/2010 | Kawanami | |
| 2010/0080623 | A1 | 4/2010 | Tanaka et al. | |
| 2010/0111562 | A1 | 5/2010 | Okabe et al. | |
| 2010/0124432 | A1 | 5/2010 | Takayama | |
| 2010/0239314 | A1 | 9/2010 | Takayama | |
| 2011/0013932 | A1 | 1/2011 | Fujita et al. | |
| 2011/0217074 | A1 | 9/2011 | Kawanami | |
| 2012/0057900 | A1 | 3/2012 | Okabe | |
| 2012/0114374 | A1 | 5/2012 | Suzuki | |
| 2012/0195627 | A1 | 8/2012 | Kikuchi | |
| 2012/0328325 | A1 | 12/2012 | Sato | |
| 2012/0328326 | A1 | 12/2012 | Sato | |
| 2012/0328327 | A1 | 12/2012 | Sato | |
| 2013/0108316 | A1 | 5/2013 | Sato et al. | |
| 2013/0308976 | A1 | 11/2013 | Sekido | |
| 2013/0315619 | A1 | 11/2013 | Shuhama et al. | |
| 2014/0064782 | A1 | 3/2014 | Furukawa et al. | |
| 2014/0137372 | A1 | 5/2014 | Yamashita et al. | |
| 2014/0147158 | A1 | 5/2014 | Fujinaka et al. | |
| 2014/0186082 | A1 | 7/2014 | Yoshikawa et al. | |
| 2014/0210929 | A1 | 7/2014 | Suzuki | |
| 2014/0241749 | A1 | 8/2014 | Okabe | |
| 2014/0294438 | A1 | 10/2014 | Okabe | |
| 2014/0314446 | A1 | 10/2014 | Sato | |
| 2015/0010325 | A1 | 1/2015 | Sato et al. | |
| 2015/0023691 | A1 | 1/2015 | Sato | |
| 2015/0071681 | A1 | 3/2015 | Sato | |
| 2015/0110523 | A1 | 4/2015 | Sato | |
| 2015/0227110 | A1 | 8/2015 | Yoshimura et al. | |
| 2016/0026151 | A1 | 1/2016 | Sato et al. | |
| 2016/0231696 | A1 | 8/2016 | Sato | |
| 2016/0231700 | A1 | 8/2016 | Sato | |
| 2016/0231703 | A1 | 8/2016 | Sato | |

FOREIGN PATENT DOCUMENTS

| | | | |
|---|---|---|---|
| JP | H09-304994 | A | 11/1997 |
| JP | H10-245145 | A | 9/1998 |
| JP | H11-344905 | A | 12/1999 |
| JP | 2000-321843 | A | 11/2000 |
| JP | 2001-337580 | A | 12/2001 |
| JP | 2004-109945 | A | 4/2004 |
| JP | 2004-177443 | A | 6/2004 |
| JP | 2005107435 | A | 4/2005 |
| JP | 2007-101635 | A | 4/2007 |
| JP | 2008-165026 | A | 7/2008 |
| JP | 2009-092914 | | 4/2009 |
| JP | 2009-157209 | A | 7/2009 |
| JP | 2010-008724 | A | 1/2010 |
| JP | 2010-072308 | A | 4/2010 |
| JP | 2010-102326 | A | 5/2010 |
| JP | 2010-117731 | A | 5/2010 |
| JP | 2010-217813 | A | 9/2010 |
| JP | 2011-059730 | A | 3/2011 |
| JP | 2011-070142 | A | 4/2011 |
| JP | 2012-073656 | A | 4/2012 |
| JP | 2013-007946 | A | 1/2013 |
| JP | 2013-007947 | A | 1/2013 |
| JP | 2013-007948 | A | 1/2013 |
| JP | 2013-097185 | A | 5/2013 |
| JP | 2013-242439 | A | 12/2013 |
| JP | 2013-246366 | A | 12/2013 |
| JP | 2014-067005 | A | 4/2014 |
| JP | 2014-067010 | A | 4/2014 |
| JP | 2014-106392 | A | 6/2014 |
| JP | 2014-106393 | A | 6/2014 |
| JP | 2014-123107 | A | 7/2014 |
| JP | 2014-126842 | A | 7/2014 |
| WO | 2011024491 | A1 | 3/2011 |
| WO | 2014038725 | A1 | 3/2014 |

OTHER PUBLICATIONS

Feb. 5, 2016—Co-pending U.S. Appl. No. 15/016,581.
Feb. 5, 2016—Co-pending U.S. Appl. No. 15/016,616.
Feb. 4, 2016—Co-pending U.S. Appl. No. 15/015,788.
Feb. 4, 2016—Co-pending U.S. Appl. No. 15/015,323.
Feb. 3, 2016—Co-pending U.S. Appl. No. 15/014,137.
May 19, 2016—U.S. Non-Final Office Action—U.S. Appl. No. 15/014,137.
Jun. 3, 2016—U.S. Ex-parte Quayle Action—U.S. Appl. No. 15/016,638.
Jun. 6, 2016—U.S. Notice of Allowance—U.S. Appl. No. 15/016,581.
Jun. 17, 2016—U.S. Non-Final Office Action—U.S. Appl. No. 15/016,616.
Aug. 12, 2016—U.S. Notice of Allowance—U.S. Appl. No. 15/014,137.
Oct. 11, 2016—U.S. Notice of Allowance—U.S. Appl. No. 15/016,616.
Oct. 13, 2016—U.S. Notice of Allowance—U.S. Appl. No. 15/016,638.
Oct. 21, 2016—U.S. Non-Final Office Action—U.S. Appl. No. 15/016,581.
Nov. 4, 2016—U.S. Non-Final Office Action—U.S. Appl. No. 15/015,788.
Aug. 11, 2017—U.S. Non-Final Office Action—U.S. Appl. No. 15/379,654.
Aug. 23, 2017—U.S. Notice of Allowance—U.S. Appl. No. 15/630,391.
Dec. 15, 2017—U.S. Non-final Office Action—U.S. Appl. No. 15/803,006.
May 8, 2018—(JP) Office Action—App 2005-022599, Eng Tran.

* cited by examiner

IMAGE FORMING APPARATUS COMPRISING PROCESS CARTRIDGE

CROSS REFERENCE TO RELATED APPLICATION

This application is a continuation of prior U.S. application Ser. No. 15/016,646, filed Feb. 5, 2016, which application claims priority from Japanese Patent Application No. 2015-022599 filed Feb. 6, 2015. The entire content of the priority application is incorporated herein by reference.

TECHNICAL FIELD

The present disclosure relates to an electro-photographic type image forming apparatus comprising a process cartridge.

BACKGROUND

A conventional electro-photographic type image forming apparatus known in the art includes a process frame and a transfer belt. The process frame accommodates the plurality of the process cartridges that include photosensitive drums for yellow, magenta, cyan and black, respectively. The transfer belt is disposed in confrontation with the all photosensitive drums.

There is an electro-photographic type image forming apparatus in which a process frame accommodating all process cartridges is moved upward for positioning the photosensitive drums with respect to the transfer belt. More specifically, the process frame accommodating the plurality of the process cartridges is movable inside and outside of a main housing through an opening of the main housing. In the interlocking relation with the operation through the opening, a side opposite to the opening, i.e., a deep side is also operated, so that the process frame positioned inside the main housing is lifted upward. Accordingly, all of the process cartridges are lifted upward, thereby positioning the photosensitive drums with respect to the transfer belt.

SUMMARY

However, according to the disclosed image forming apparatus, the process frame is lifted upward while the process frame is moved toward the deep side, since the operation at the opening side is interlockingly transmitted to the deep side of the main housing for lifting the process frame. That is, the process cartridges are lifted diagonally upward due to the diagonal movement of the process frame. Since it is difficult to applying pressing force on the photosensitive drums against the transfer belt accurately, accuracy of the positioning operation may be degraded.

Further, in the positioning operation, the portion of the process frame at the opening side needs to be firstly lifted upward, and the lifting movement is consequently interlocked toward the deeper side of the main housing. Therefore, pressing force cannot be applied sufficiently to the process cartridge positioned opposite to the opening, as compared to the process cartridge positioned at the opening side. Consequently, the positioning operation for the photosensitive drum at the deep side of the process cartridge may be malfunctioned.

It is therefore an object of an embodiment of the disclosure to provide an image forming apparatus capable of accurately positioning the photosensitive drum with respect to the positioning member.

According to one aspect, an image forming apparatus includes a body casing, a plurality of process cartridges, and a moving member. The body casing includes a positioning member. Each plurality of process cartridge includes a photosensitive drum having a rotation axis extending in a first direction. The plurality of process cartridges is configured to move between an engaging position and a release position in a second direction perpendicular to the first direction. The photosensitive drum and the positioning member engage with each other in the engaging position, and the photosensitive drum and the positioning member are disengaged from each other releasing the engagement in the release position. The moving member has an end portion defining a pivot axis, and is configured to pivotally move between a pressing position and a non-pressing position about the pivot axis. The moving member in the pressing position is configured to exert pressure on the plurality of process cartridges so that the plurality of process cartridges is moved to the engaging position. The moving member in the non-pressing position is configured to release the pressure so that the plurality of process cartridges is moved to the release position.

DETAILED DESCRIPTION

1. Entire Configuration of Printer

Figure 1:
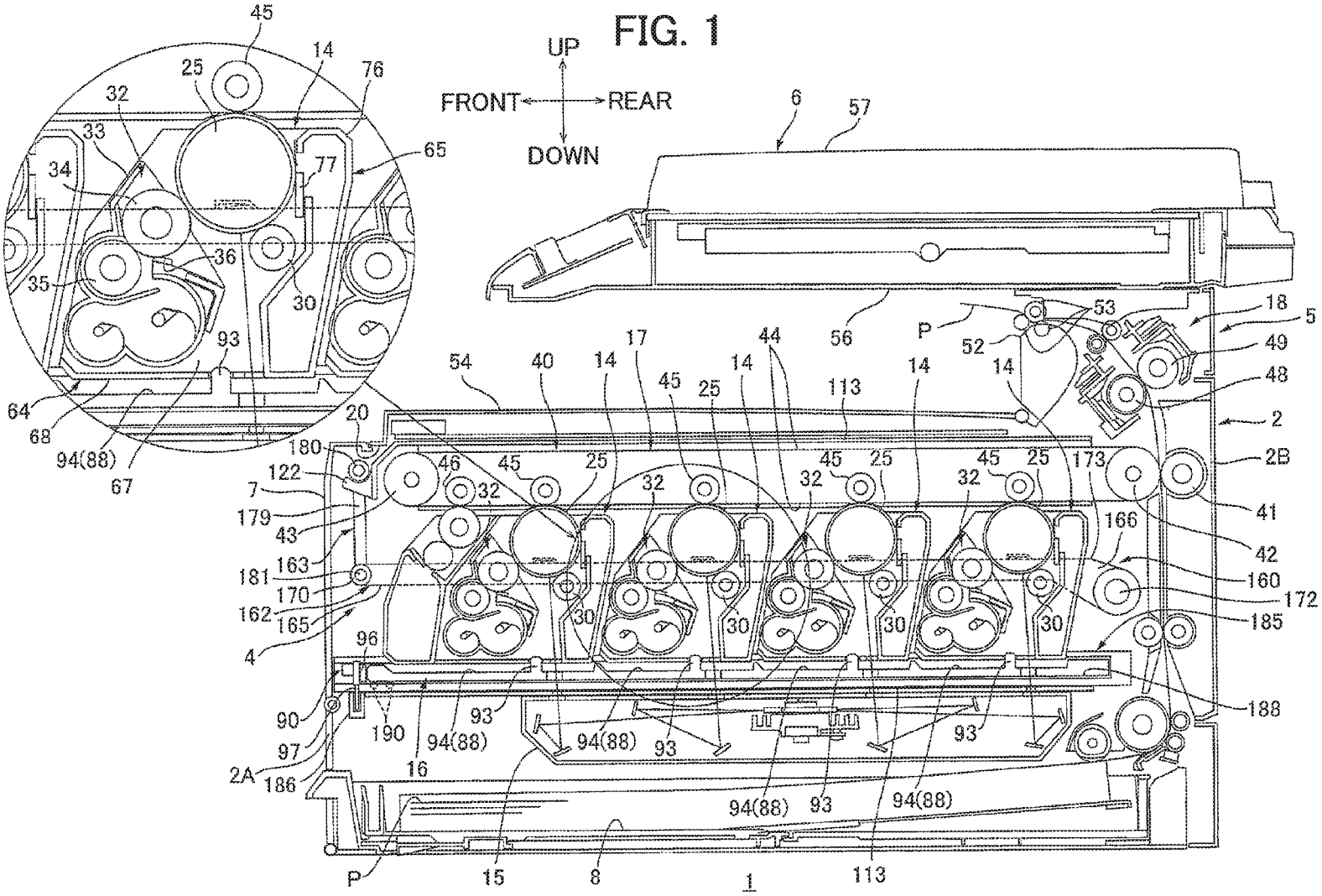
FIG. 1 is a cross-sectional view of a printer as an example of an image forming apparatus according to a first embodiment and showing a state where a drawer is at its internal position.

As illustrated in FIG. 1, a printer 1 as an example of the image forming apparatus is a horizontal intermediate transfer type color printer.

The terms "upward", "downward", "upper", "lower", "above", "below", "beneath", "right", "left", "front", "rear" and the like will be used throughout the description assuming that the printer 1 is disposed in an orientation in which it is intended to be used. In use, the printer 1 is disposed as shown in FIG. 1.

The printer 1 includes a body casing 2, an image forming unit 4 which forms an image on a sheet P, a sheet discharging unit 5 for discharging the sheet P on which the image has been formed, and an image reading unit 6 which reads image information of an original.

The body casing 2 has a substantially box shape. The body casing 2 includes a first wall 2A which includes an opening 20 and is disposed at the front end portion thereof, a second wall 2B which faces the first wall 2A and is disposed at the rear end portion thereof, a front cover 7 which is an example of a cover, and a sheet feeding tray 8.

The opening 20 is formed so that the inside and the outside of the body casing 2 in the frontward/rearward direction (the third direction) communicate with each other.

The front cover 7 is pivotable about the lower end portion of the first wall 2A of the body casing 2 as a support point between a closing position (FIG. 1) where the opening 20 is closed and an opening position (FIG. 6) where the opening 20 is opened.

As illustrated in FIG. 1, the sheet feeding tray 8 is disposed inside the lower end portion of the body casing 2. The sheet feeding tray 8 is attachable to and detachable from the body casing 2. The sheet feeding tray 8 stores the sheet P. The sheet in the sheet feeding tray 8 is transported between an intermediate transfer belt 44 and a secondary transfer roller 41 to be described later at a predetermined timing by various rollers.

Further, the upper surface of the body casing 2 is defined as a sheet discharging tray 54.

The image forming unit 4 includes a scanner unit 15, a drawer 16, four process cartridges 14 (i.e., a plurality of process cartridges 14), a transfer unit 17, and a fixing unit 18.

The scanner unit 15 is disposed above the sheet feeding tray 8 at the lower portion of the body casing 2. As indicated by the solid lines, the scanner unit 15 exposes four photosensitive drums 25 (i.e., the plurality of photosensitive drums 25) by emitting a laser beam based on image data to the four photosensitive drums 25.

Although it will be described later in detail, the drawer 16 is disposed upward of the scanner unit 15 at the substantially center of the body casing 2 in the upward/downward direction (the second direction).

Although it will be described later in detail, each of the four process cartridges 14 includes the photosensitive drum 25, a charging roller 30 which charges the surface of the photosensitive drum 25, and a developing unit 32 which develops a toner image based on the electrostatic latent image on the surface of the photosensitive drum 25 by the scanner unit 15. Four process cartridges 14 are supported by the drawer 16.

The transfer unit 17 is disposed above the four process cartridges 14 at the upper portion of the body casing 2. The transfer unit 17 includes a belt unit 40 and a secondary transfer roller 41.

The belt unit 40 is disposed in the frontward/rearward direction so as to be located upward of all the photosensitive drums 25. The belt unit 40 includes a drive roller 42, a driven roller 43, an intermediate transfer belt 44, four primary transfer rollers 45 (i.e., a plurality of primary transfer rollers 45) which primarily transfer the toner images of the four photosensitive drums 25 to the intermediate transfer belt 44 in a sequential manner, and an opposite roller 46.

The drive roller 42 is rotatably supported by the rear end portion of the belt unit 40 so as to be.

The driven roller 43 is rotatably supported by the front end portion of the belt unit 40.

The intermediate transfer belt 44 is suspended between the drive roller 42 and the driven roller 43 at the circumference thereof so that the lower portion of the intermediate transfer belt contacts the upper end portions of all photosensitive drums 25. Further, the intermediate transfer belt 44 circularly rotates in the circumferential direction so that the lower portion moves from the front side toward the rear side upon rotation of the drive roller 42 and the driven roller 43.

The four primary transfer rollers 45 are disposed between the drive roller 42 and the driven roller 43 at a predetermined gap in the frontward/rearward direction so that the primary transfer rollers 45 are disposed in parallel respectively above each of the four photosensitive drums 25. The primary transfer rollers 45 interpose the intermediate transfer belt 44 in cooperation with the four photosensitive drums 25. Each primary transfer roller 45 contacts the lower portion of the intermediate transfer belt 44 from the upside.

The opposite roller 46 is disposed between the foremost primary transfer roller 45 and the driven roller 43. The opposite roller 46 contacts the lower portion of the intermediate transfer belt 44 from the upside.

The secondary transfer roller 41 is disposed at the rearward of the drive roller 42 so as to interpose the intermediate transfer belt 44 in cooperation with the drive roller 42. The secondary transfer roller 41 is configured to secondarily transfer the color image on the surface of the intermediate transfer belt 44 to the sheet P conveyed from the sheet feeding tray 8.

The fixing unit 18 is disposed above the secondary transfer roller 41. The fixing unit 18 includes a heating roller 48 and a pressing roller 49 which comes into press-contact with the rear upper end portion of the heating roller 48. The fixing unit 18 is configured to thermally fix the image onto the sheet P as the sheet P on which the color image has been transferred passes between the heating roller 48 and the pressing roller 49.

The sheet discharging unit 5 protrudes upward from the rear upper end portion of the body casing 2. The sheet discharging unit 5 includes a discharging opening 52 which discharges the sheet P passing through the fixing unit 18 to the sheet discharging tray 54 and three sheet discharging rollers 53.

The discharging opening 52 is formed at the front surface of the sheet discharging unit 5 so that the inside and the outside of the body casing 2 communicate with each other.

Three sheet discharging rollers 53 are disposed so as to guide the sheet P discharged from the discharging opening 52 by nipping the sheet.

The image reading unit 6 is disposed above the body casing 2 so as to cover the sheet discharging tray 54. The image reading unit 6 has a substantially rectangular shape in the top view which has substantially the same length as the body casing 2 in the frontward/rearward direction and the leftward/rightward direction (the first direction). The image reading unit 6 includes an original table 56 which places an original thereon and a pressing cover 57 which is supported by the original table 56 so as to be swingable.

As described above, the image forming unit 4 is capable of forming an image of the sheet P based on the image information of the original read by the image reading unit 6.

2. Detail of Process Cartridge

Figure 5:
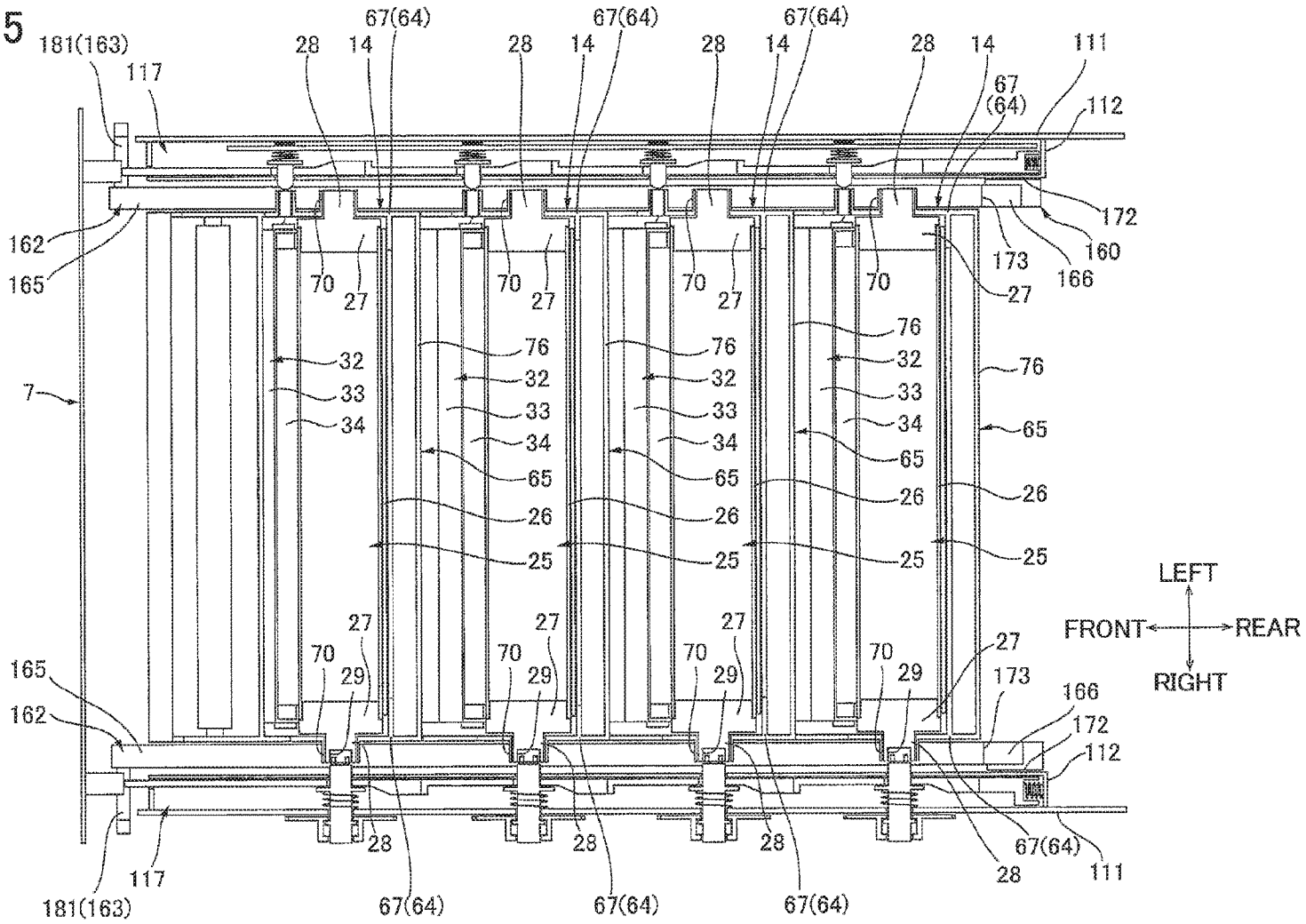
FIG. 5 is a cross-sectional view taken along a line B-B of FIG. 5.

The four process cartridges 14 have substantially the same configuration except that the colors of the toner stored therein. The process cartridge 14 includes, as illustrated in FIGS. 1 and 5, a cartridge frame 64, the photosensitive drum 25, the charging roller 30, the developing unit 32, and a drum cleaning unit 65.

In addition, the reference numerals of the members of the process cartridge 14 in FIG. 1 are illustrated in the enlarged view in order to simplify the drawing.

Figure 6:
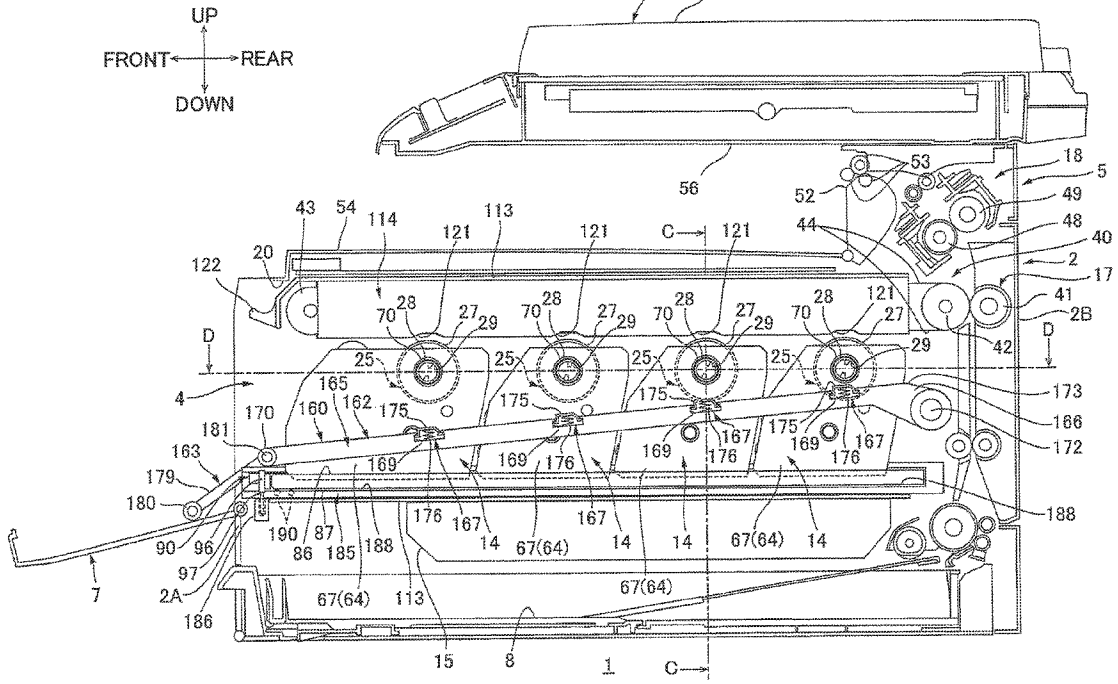
FIG. 6 is a cross-sectional view of the printer shown in FIG. 3, and showing a state where the moving arm is at its non-pressing position, and process cartridges are at their release positions.
Figure 7:
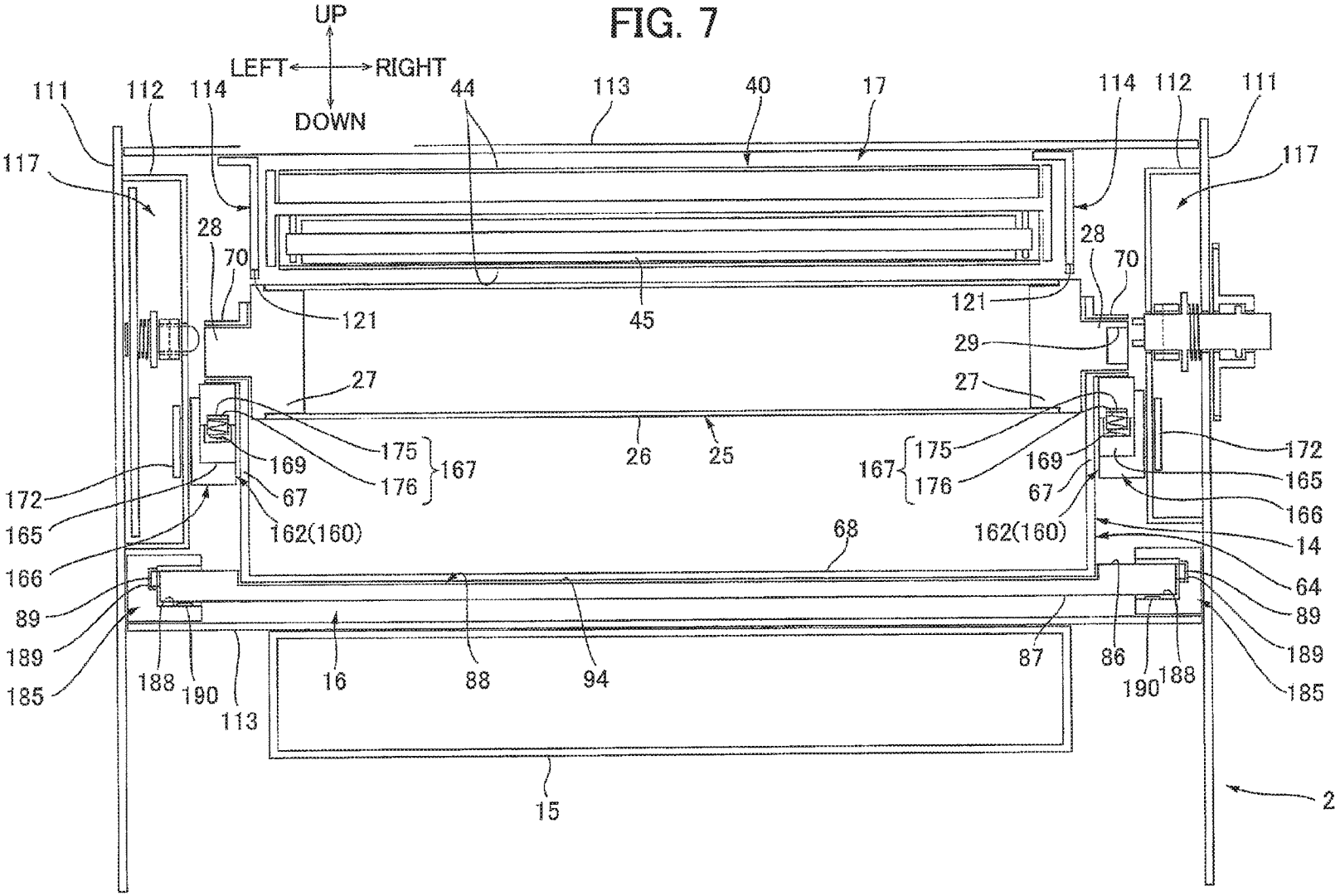
FIG. 7 is a cross-sectional view taken along a line C-C of FIG. 6.

Further, the process cartridge 14 is vertically movable between an engagement position (FIGS. 3 and 4) and a release position (FIGS. 6 and 7). In the engagement position, the upper end portions of the four photosensitive drums 25 contact the lower portion of the intermediate transfer belt 44; in the release position, the four photosensitive drums 25 are separated from the intermediate transfer belt 44.

(1) Cartridge Frame

Figure 4:
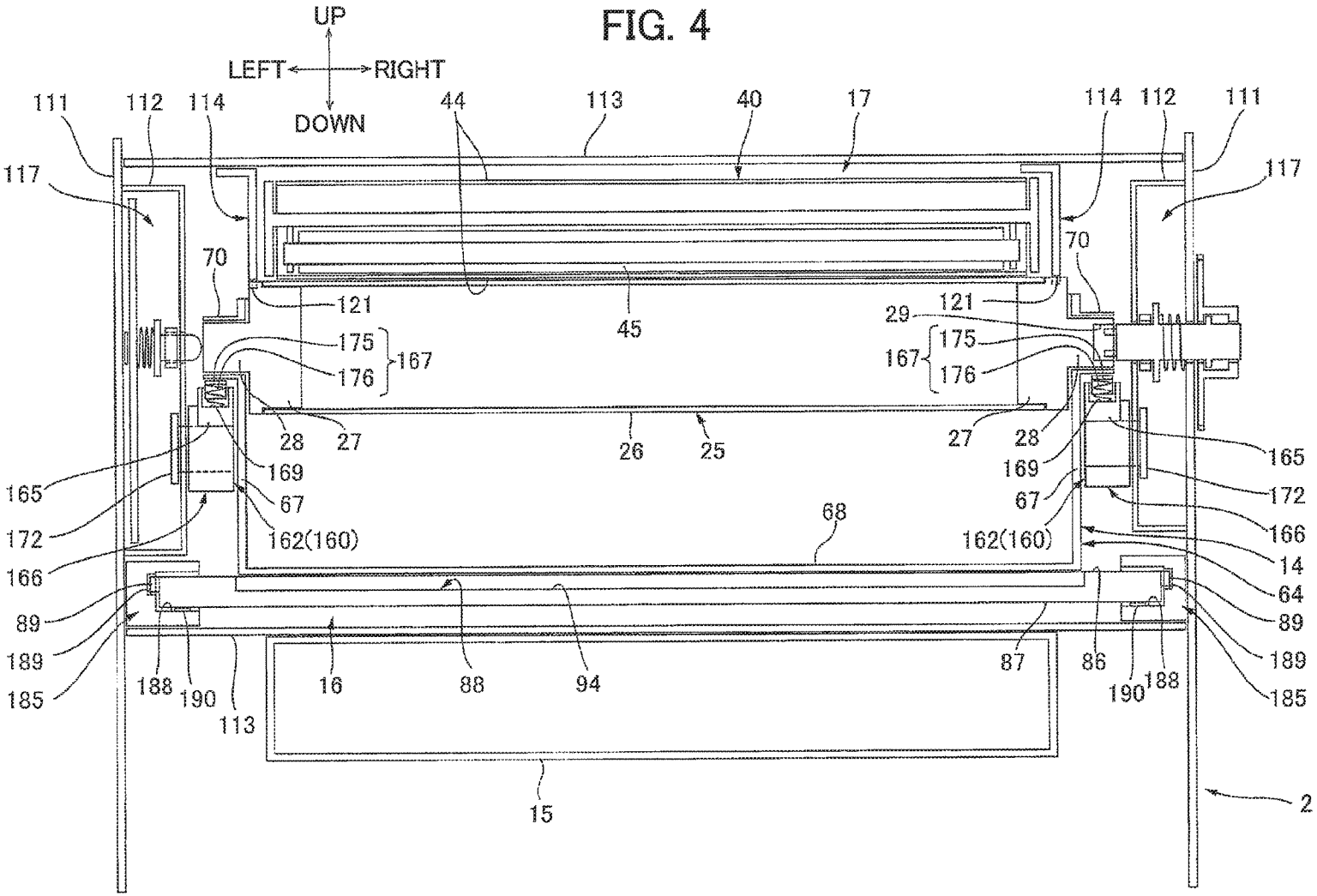
FIG. 4 is a cross-sectional view taken along a line A-A of FIG. 3.

The cartridge frame 64 includes, as illustrated in FIGS. 1 and 4, a pair of side walls 67 and a bottom wall 68.

The pair of side walls 67 is disposed so as to be separated from each other in the leftward/rightward direction. The side wall 67 has a substantially rectangular flat plate shape extending in the upward/downward direction and the frontward/rearward direction in the side view. Each of the pair of side walls 67 includes a flange support portion 70.

Figure 3:
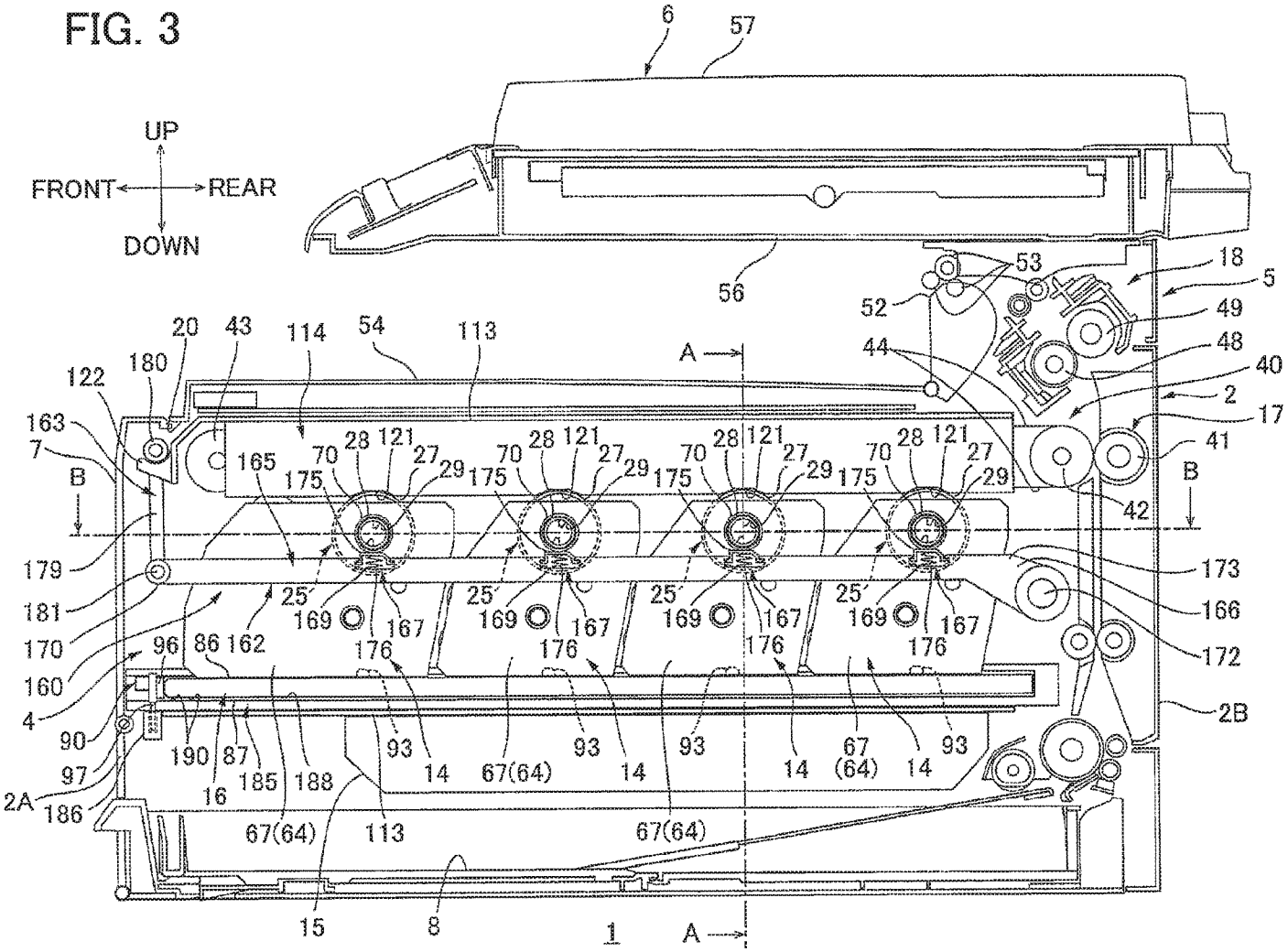
FIG. 3 is a cross-sectional view of the printer shown in FIG. 1 and taken along a plane which is rightward of a moving arm, and showing a state where the moving arm is at its pressing position, and process cartridges are at their engagement positions.

As illustrated in FIGS. 3 and 4, the flange support portion 70 has a substantially cylindrical shape which protrudes outward in the leftward/rightward direction from the substantially center portion in the frontward/rearward direction of the upper end portion of the side wall 67. The flange support portion 70 penetrates the side wall 67.

The bottom wall 68 is suspended between the lower end portions of the pair of side walls 67 as illustrated in FIGS. 1 and 4. The bottom wall 68 has a substantially rectangular flat plate shape extending in the frontward/rearward direction and the leftward/rightward direction in the bottom view.

(2) Photosensitive Drum

The photosensitive drum 25 is disposed at the upper end portion of the substantially center in the frontward/rearward direction of the process cartridge 14 as illustrated in FIGS. 1 and 4. The photosensitive drum 25 is rotatable about the rotation axis extending in the leftward/rightward direction. The photosensitive drum 25 includes a drum 26 and a pair of flanges 27.

The drum 26 has a substantially cylindrical shape extending in the leftward/rightward direction as illustrated in FIG. 4. The drum 26 is formed so that a photosensitive layer of formed on a surface thereof.

The left flange 27 of the pair of flanges 27 is disposed at the left end portion of the drum 26. The right flange 27 of the pair of flange 27 is disposed at the right end portion of the drum 26. The flange 27 has a substantially disk shape in which the radial direction extends in the upward/downward direction and the frontward/rearward direction. The outer diameter of the flange 27 is substantially equal to the outer diameter of the drum 26. The flange 27 includes a protrusion portion 28.

The protrusion portion 28 has a substantially columnar shape extending outward in the leftward/rightward direction from the substantially center of the flange 27 in the radial direction. In addition, the right protrusion portion 28 includes a hole 29.

As illustrated in FIGS. 3 and 4, the hole 29 is recessed leftward from the radial center portion of the right protrusion portion 28. The hole 29 has a substantially circular shape in the side view.

The photosensitive drum 25 is rotatably supported by the side wall 67 because the protrusion portion 28 of the flange 27 is rotatably supported by the flange support portion 70 of the side wall 67. The left and right outer end surfaces of the protrusion portion 28 are at substantially equal positions to the left and right outer end surfaces of the flange support portion 70 of the side wall 67 when viewed from the front side as illustrated in FIG. 4.

(3) Developing Unit

The developing unit 32 is disposed at a position forward and downward of the photosensitive drum 25 so as to store a toner therein as illustrated in FIG. 1. The developing unit 32 includes a developing frame 33, a developing roller 34, a supply roller 35, and a layer thickness regulation blade 36.

The developing frame 33 is disposed at a position forward and downward of the photosensitive drum 25. The developing frame 33 extends in the leftward/rightward direction and has a substantially prismatic shape having left and right closed ends. The rear upper end portion of the developing frame 33 has an open end entirely along the dimension in the leftward/rightward direction, through which the inside and outside of the developing frame 33 communicate with each other.

The developing roller 34 is configured to supply toner onto the surface of the photosensitive drum 25. The developing roller 34 has a substantially columnar shape extending in the leftward/rightward direction and is disposed at the rear upper end portion of the developing frame 33. The rear upper end portion of the developing roller 34 is exposed from the developing frame 33. The rear upper end portion of the developing roller 34 contacts the front lower end portion of the photosensitive drum 25.

The supply roller 35 is configured to supply a toner inside the developing unit 32 to the developing roller 34. The supply roller 35 has a substantially columnar shape extending in the leftward/rightward direction. The supply roller 35 is disposed at a position frontward and downward of the developing roller 34, and is disposed at the substantially center portion of the developing frame 33 in the upward/downward direction. The rear upper end portion of the supply roller 35 comes into press-contact with the front lower end portion of the developing roller 34.

The layer thickness regulation blade 36 is configured to regulate the thickness of the toner supplied to the developing roller 34. The layer thickness regulation blade 36 is disposed at a position frontward and downward of the developing roller 34. The layer thickness regulation blade 36 has a substantially flat plate shape extending in the leftward/rightward direction. The layer thickness regulation blade 36 has a thickness in a direction from the rear upper position to the front lower position. The front upper end portion of the layer thickness regulation blade 36 contacts the lower end portion of the developing roller 34.

(4) Drum Cleaning Unit

The drum cleaning unit 65 is disposed behind the photosensitive drum 25 at the rear end portion of the process cartridge 14 and is configured to collect a waste toner from the surface of the photosensitive drum 25. The drum cleaning unit 65 includes a cleaning frame 76 and a cleaning blade 77.

3. Detail of Drawer

Figure 9:
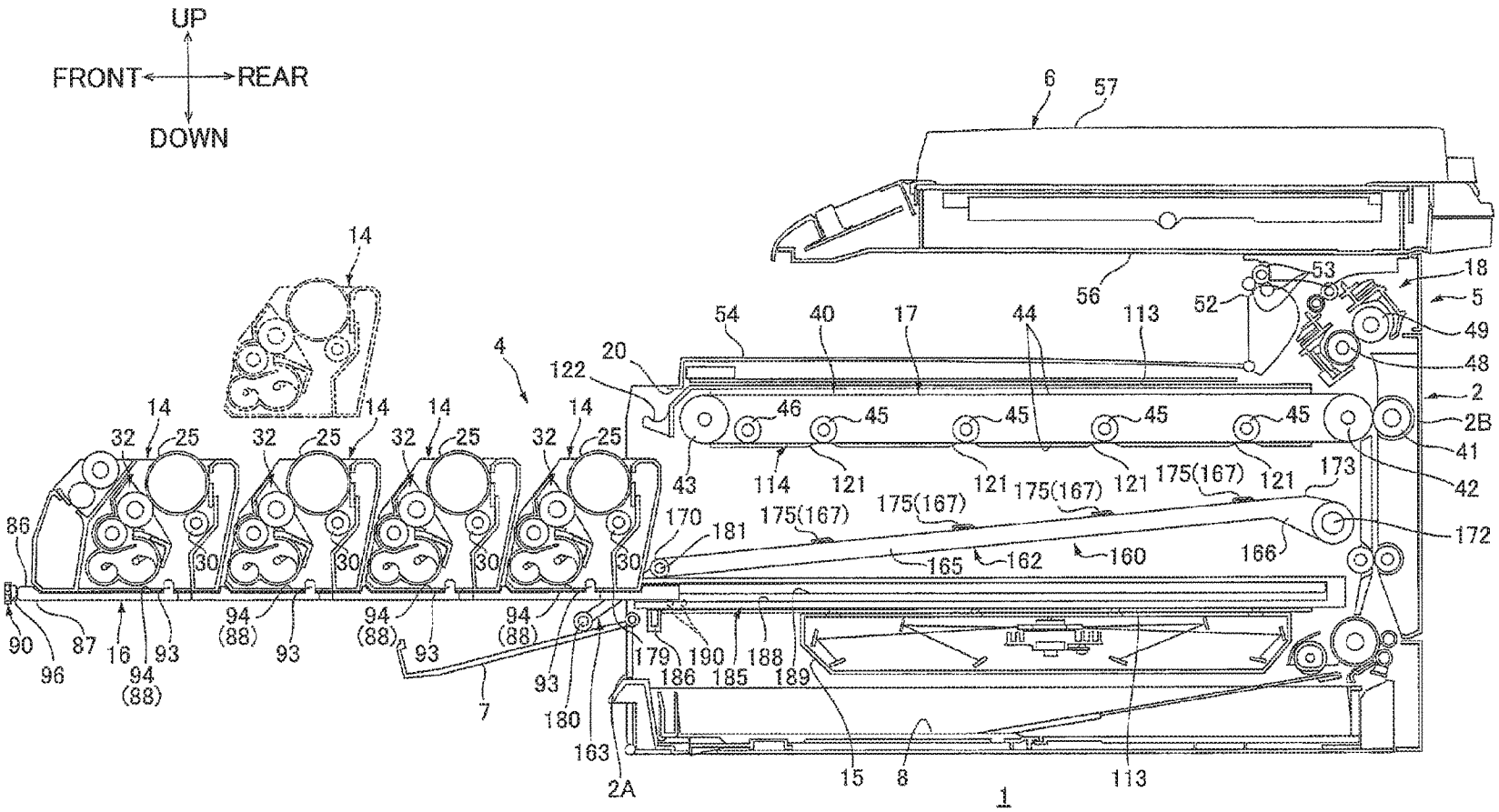
FIG. 9 is a cross-sectional view of the printer shown in FIG. 1 and showing a state where the drawer is at its external position.

The drawer 16 is configured to support the four process cartridges 14. The drawer 16 is movable in the frontward/ rearward direction between an internal position (FIGS. 1 and 3) and an external position (FIG. 9). When the drawer 16 is in the internal position, the drawer 16 is located inside the body casing 2. When the drawer 16 is in the external position, the drawer 16 is located outside the body casing 2.

Figure 2:
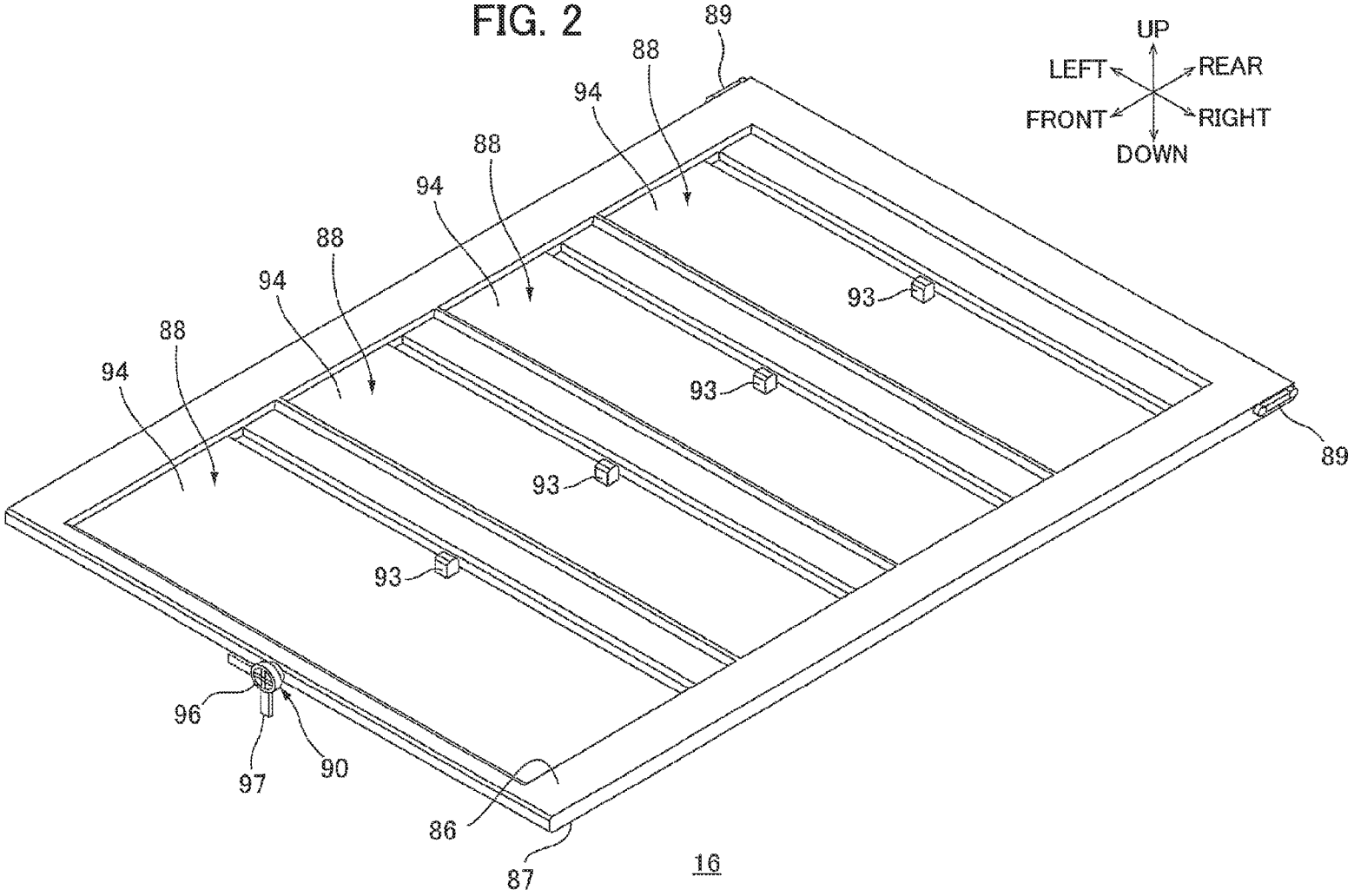
FIG. 2 is a perspective view of the drawer as viewed from frontward and upward of the drawer.

The drawer 16 has a substantially rectangular flat plate shape extending in the frontward/rearward direction and the leftward/rightward direction as illustrated in FIGS. 1 and 2. More specifically, an upper surface 86 of the drawer 16 is in the vicinity of a lower surface 87, vertically. The drawer 16 extends in the frontward/rearward direction and the leftward/rightward direction so as to have a substantially uniform thickness. In other words, the drawer 16 is disposed in substantially the same plane shape extending in both the leftward/rightward direction and the frontward/rearward direction. Further, the drawer 16 does not include a side plate extending in the upward/downward direction from the peripheral edge thereof. The dimension, that is, the thickness of the drawer 16 in the upward/downward direction is from 5 to 30 percent of the dimension of the process cartridge 14 in the upward/downward direction. Specifically, the dimension, that is, the thickness of the drawer 16 in the upward/downward direction is 10 percent of the dimension of the process cartridge 14 in the upward/downward direction. The drawer 16 includes a plurality of, that is, four concave portions 88, a pair of rollers 89, and a stopper 90.

Four concave portions 88 are disposed so as to be separated from one another in the frontward/rearward direction. The concave portion 88 is recessed downward from the upper surface of the drawer 16. The concave portion 88 has a substantially rectangular shape in the top view. Each of the four concave portions 88 includes a regulation portion 93.

The regulation portion 93 is disposed at the substantially center portion of the concave portion 88 in the top view. The regulation portion 93 has a substantially prismatic shape extending upward from the lower surface of the concave portion 88.

In addition, a lower surface excluding the regulation portion 93 in the concave portion 88 is defined as a support surface 94 of the process cartridge 14.

One of the pair of rollers 89 is disposed at the left rear end portion of the drawer 16. The other of the pair of rollers 89 is disposed at the right rear end portion of the drawer 16. The roller 89 is rotatable about the axis extending in the leftward/rightward direction.

The stopper 90 is disposed at the front end portion of the drawer 16. The stopper 90 includes a shaft portion 96 and an insertion portion 97.

The shaft portion 96 has a substantially columnar shape extending backward from the substantially center of the front end portion of the drawer 16 in the leftward/rightward direction. The shaft portion 96 is rotatable with respect to the drawer 16.

The insertion portion 97 has a substantially prismatic shape extending outward in the radial direction of the shaft portion 96 from the peripheral edge of the shaft portion 96.

Accordingly, the stopper 90 is rotatable about the shaft portion 96 between a regulation position and a non-regulation position. When the stopper 90 is in the regulation position, the insertion portion 97 is directed so as to be located below the lower surface 87 of the drawer 16. When the stopper 90 is in the non-regulation position, the insertion portion 97 is directed leftward so as to be located between the upper surface 86 and the lower surface 87 of the drawer 16.

4. Detail of Body Casing (1) Configuration of Frame of Body Casing

The body casing 2 includes, as illustrated in FIG. 4, a pair of side walls 111, a pair of frames 112, a pair of connection plates 113, and a pair of positioning members 114.

The side walls 111 are separated from each other in the leftward/rightward direction. The side wall 111 has a substantially rectangular plate shape extending in the frontward/rearward direction.

The pair of frames 112 is disposed inside the pair of side walls 111. Each frame 112 has a substantially box shape having left and right open ends. Then, since the outer end portion of the frame 112 in the leftward/rightward direction is continuous to the inner surface of the side wall 111, a storage space 117 is defined therein.

The pair of connection plates 113 includes upper and lower connection plates 113. The upper connection plate 113 is suspended between the upper end portions of the pair of side walls 111. The lower connection plate 113 is suspended between the lower end portions of the pair of side walls 111. The upper connection plate 113 is disposed at the upper portion of the body casing 2, and is above the belt unit 40. The lower connection plate 113 is disposed above the scanner unit 15 at the lower portion of the body casing 2 so as to support and position the scanner unit 15. Each connection plate 113 has a substantially rectangular plate shape extending in the frontward/rearward direction. Further, the upper connection plate 113 includes a hook-shaped portion 122 as illustrated in FIGS. 1 and 3.

The hook-shaped portion 122 has a substantially hook shape which is bent downward from the front end portion of the upper connection plate 113 and is bent forward and upward.

The pair of positioning members 114 includes right and left positioning members 114. As illustrated in FIGS. 3 and 4, the left positioning member 114 is disposed at the left side of the belt unit 40 and below the upper connection plate 113. The right positioning member 114 is disposed at the right side of the belt unit 40 above the lower connection plate 113. The positioning member 114 has a substantially rectangular plate shape extending in the frontward/rearward direction in the side view. Each positioning member 114 includes a plurality of, that is, four positioning concave portions 121.

The four positioning concave portions 121 are separated from one another in the frontward/rearward direction as illustrated in FIG. 3. The positioning concave portion 121 is recessed upward in a substantially circular-arc shape from the lower edge of the positioning member 114 in the side view. The positioning concave portion 121 has a shape conforming to the peripheral edge of the flange 27 of the photosensitive drum 25. In other words, the positioning concave portion 121 is recessed in a direction separated from the photosensitive drum 25.

(2) Configuration of Body Casing Pressing Process Cartridge

The body casing 2 includes a pivot portion 160 as illustrated in FIGS. 3 and 4.

The pivot portion 160 includes a pair of moving arms 162 as an example of a moving member and a connection portion 163.

The moving arms 162 are separated from each other in the leftward/rightward direction. Each moving arm 162 is disposed between the frame 112 and the four process cartridges 14. The moving arms 162 are disposed upward of the left and right end portions of the drawer 16 so as to interpose the process cartridge 14 therebetween. That is, the left moving arm 162 overlaps with the left end portion of the drawer 16 when viewed in the vertical direction in the state where the drawer 16 is in the internal position. The right moving arm 162 overlaps with the right end portion of the drawer 16 when viewed in the vertical direction in the state where the drawer 16 is in the internal position. Further, the gap between the left moving arm 162 and the left side wall 111 is greater than the gap between the drawer 16 and the left side wall 111 in the leftward/rightward direction. The gap between the right moving arm 162 and the right side wall 111 is greater than the gap between the drawer 16 and the right side wall 111 in the leftward/rightward direction. The moving arm 162 includes a body portion 165, a base portion 166, and four urging members 167 (i.e., a plurality of urging members).

The body portion 165 has a substantially prismatic shape extending in the frontward/rearward direction. The body portion 165 includes four storage portions 169 (i.e., a plurality of storage portions 169), and a hole 170.

The four storage portions 169 are separated from one another in the frontward/rearward direction. The storage portion 169 is recessed downward from the upper surface of the body portion 165. The storage portion 169 has a substantially rectangular shape in the top view.

The hole 170 is formed at the front end portion of the body portion 165. The hole 170 is formed in a substantially cylindrical shape extending in the leftward/rightward direction.

The base portion 166 has a substantially prismatic shape extending backward and downward from the rear end portion of the body portion 165. That is, the base portion 166 extends in a direction crossing the extending direction of the body portion 165. The base portion 166 includes a pivot shaft 172.

The pivot shaft 172 has a substantially columnar shape protruding outward from the outer surface of the rear lower end portion of the base portion 166 in the leftward/rightward direction. The outer end portion of the pivot shaft 172 in the leftward/rightward direction penetrates the frame 112 and is disposed inside the storage space 117 so that the position thereof is fixed. In addition, the pivot shaft 172 of the left moving arm 162 and the pivot shaft 172 of the right moving arm 162 have a common pivot center in the side view. Further, the pivot shaft 172 is disposed backward of the process cartridge 14 at the backmost side of the drawer 16. In other words, the pivot shaft 172 is positioned closer to the second wall 2B than is to the first wall 2A in the state where the drawer 16 is located at an internal position, described later.

Accordingly, the moving arm 162 is pivotable about the pivot shaft 172.

Further, a portion continuously connecting the body portion 165 and the base portion 166 is a curved portion 173. The curved portion 173 is positioned between the pivot shaft 172 and the storage portion 169 at the backmost position among the four storage portions 169. The curved portion 173 has a bending portion whose bend angle is 18 degrees with respect to the moving arm 162.

The urging member 167 includes a backing plate 175 and a spring 176.

The backing plate 175 is vertically movable inside the storage portion 169. The backing plate 175 has a substantially U-shape, and has a substantially center portion in the frontward/rearward direction, which protrudes upward in the side sectional view.

The spring 176 has a steel wire wound in a coil shape and in a spiral shape extending in the upward/downward direction. The spring 176 is disposed in a compressed state inside the storage portion 169 so that the upper end thereof contacts the backing plate 175 and the lower end thereof contacts the bottom surface of the storage portion 169. Accordingly, the spring 176 constantly urges the backing plate 175 upward.

In addition, the moving arm 162 is pivotable about the pivot shaft 172 between a pressing position (FIGS. 3 and 4) and a non-pressing position (FIGS. 6 and 7). When the moving arm 162 is in the pressing position, the four process cartridges 14 are pressed toward the engagement position. When the moving arm 162 is in the non-pressing position, the pressing force on the four process cartridges 14 is released. The pivot angle of the moving arm 162 between the pressing position and the non-pressing position falls within the range from 3 degrees to 10 degrees with respect to the pivot shaft 172.

The four photosensitive drums 25 defines a horizontal plane passing through the central axes of the four photosensitive drums 25. The horizontal plane has vertical distances to the moving arm 162 at the positions of urging members 167, which are 19 mm, 14 mm, 7 mm, and 2 mm, when the moving arm 162 is in the non-pressing position.

The connection portion 163 includes, as illustrated in FIGS. 3 and 5, a pair of connection arms 179 and a gripping portion 180. The connection portion 163 will be described on the basis of the position illustrated in FIG. 3.

Each connection arm 179 has a substantially prismatic shape extending in the upward/downward direction. The connection arm 179 includes an insertion portion 181.

The insertion portion 181 has a substantially columnar shape extending inward in the leftward/rightward direction from the lower end portion of the connection arm 179. The inner end portion of the insertion portion 181 in the leftward/rightward direction is rotatably inserted in the hole 170.

The gripping portion 180 connects the upper end portions of the pair of connection arms 179. The gripping portion 180 has a substantially columnar shape extending in the leftward/rightward direction.

The connection portion 163 is connected to the front end portions of the pair of moving arms 162 and is pivotable about the insertion portion 181 with respect to the moving arm 162.

In addition, when the gripping portion 180 engages with the hook-shaped portion 122, the connection portion 163 fixes the pair of moving arms 162 at the pressing position. When the engagement between the gripping portion 180 and the hook-shaped portion 122 is released, the gripping portion 180 releases the pair of moving arms 162 so that the moving arms 162 moves from the pressing position to the non-pressing position.

Further, the extending direction of the gripping portion 180 intersects the extending direction of the body portion 165.

(3) Configuration of Moving Drawer in Body Casing

The body casing 2 includes a pair of guide rails 185 and an engagement portion 186 as illustrated in FIGS. 1 and 4.

Each guide rail 185 is disposed downward of the frame 112 and upward of the lower connection plate 113. The guide rail 185 has a substantially prismatic shape extending in the frontward/rearward direction. The guide rail 185 includes a first guide groove 188, a second guide groove 189, and a roller 190.

Each first guide groove 188 has an inner surface facing to the leftward/rightward direction. The first guide groove 188 is recessed outward in the leftward/rightward direction from the inner surface of the guide rail 185. The first guide groove 188 extends from the rear end portion to the front end portion of the guide rail 185 to have a front open end. The first guide groove 188 has a substantially rectangular shape in the cross-sectional view.

The second guide groove 189 is recessed outward in the leftward/rightward direction from the upper end portion of the inner surface of the first guide groove 188. The second guide groove 189 extends from the rear end portion to the front end portion of the first guide groove 188 to form a front closed end. The second guide groove 189 has a substantially rectangular shape in the cross-sectional view.

The roller 190 is rotatable about an axis extending in the leftward/rightward direction. The roller 190 is disposed so that the upper end portion is exposed from the lower surface of the front end portion of the first guide groove 188.

As illustrated in FIG. 1, the engagement portion 186 is disposed between the front end portions of the pair of guide rails 185. Specifically, the engagement portion 186 is at the substantially center portion in the leftward/rightward direction. The engagement portion 186 is a thick plate having a substantially U-shape forming an upper open end in the side sectional view.

5. Attachment of Process Cartridge to Body Casing

The following explanation is based on the state where the four cartridges 14 are attached to the body casing 2. As illustrated in FIGS. 1 and 3, when the four process cartridges 14 are attached to the body casing 2, the members are positioned as follows: the drawer 16 is in the internal position, the stopper 90 is in the regulation position, the pair of moving arms 162 is in the pressing position, the process cartridges 14 are in the engagement position, and the front cover 7 is in the closing position.

The process cartridges 14 are positioned upward of the concave portion 88 of the corresponding drawer 16.

The drawer 16 is supported inside the body casing 2 so that both end portions thereof in the leftward/rightward direction are received by the first guide grooves 188 of the pair of guide rails 185. The pair of rollers 89 is received by the second guide grooves 189 of the pair of guide rails 185.

The stopper 90 of the drawer 16 is positioned at the regulation position, and the insertion portion 97 is received by the engagement portion 186 so that the movement of the drawer 16 in the frontward/rearward direction is regulated.

As illustrated in FIG. 3, the gripping portions 180 of the connection portions 163 of the pivot portion 160 engage with the hook-shaped portions 122. Accordingly, the body portions 165 of the moving arms 162 are horizontally positioned to extend in the frontward/rearward direction. The backing plates 175 of the urging members 167 contact the lower end portions of the flange support portions 70 of the corresponding process cartridges 14 so as to press the process cartridges 14 upward.

Further, the process cartridges 14 are urged by the urging force of the springs 176 in the urging members 167.

Accordingly, the process cartridges 14 are lifted upward so that the bottom walls 68 are separated from and do not contact the support surfaces 94 of the concave portions 88. The flanges 27 of the photosensitive drums 25 engage with the corresponding positioning concave portions 121.

In this way, the photosensitive drums 25 are positioned by the positioning members 114 so that the photosensitive drums 25 contact the lower portion of the intermediate transfer belt 44.

6. Detachment Operation of Process Cartridge

Figure 8:
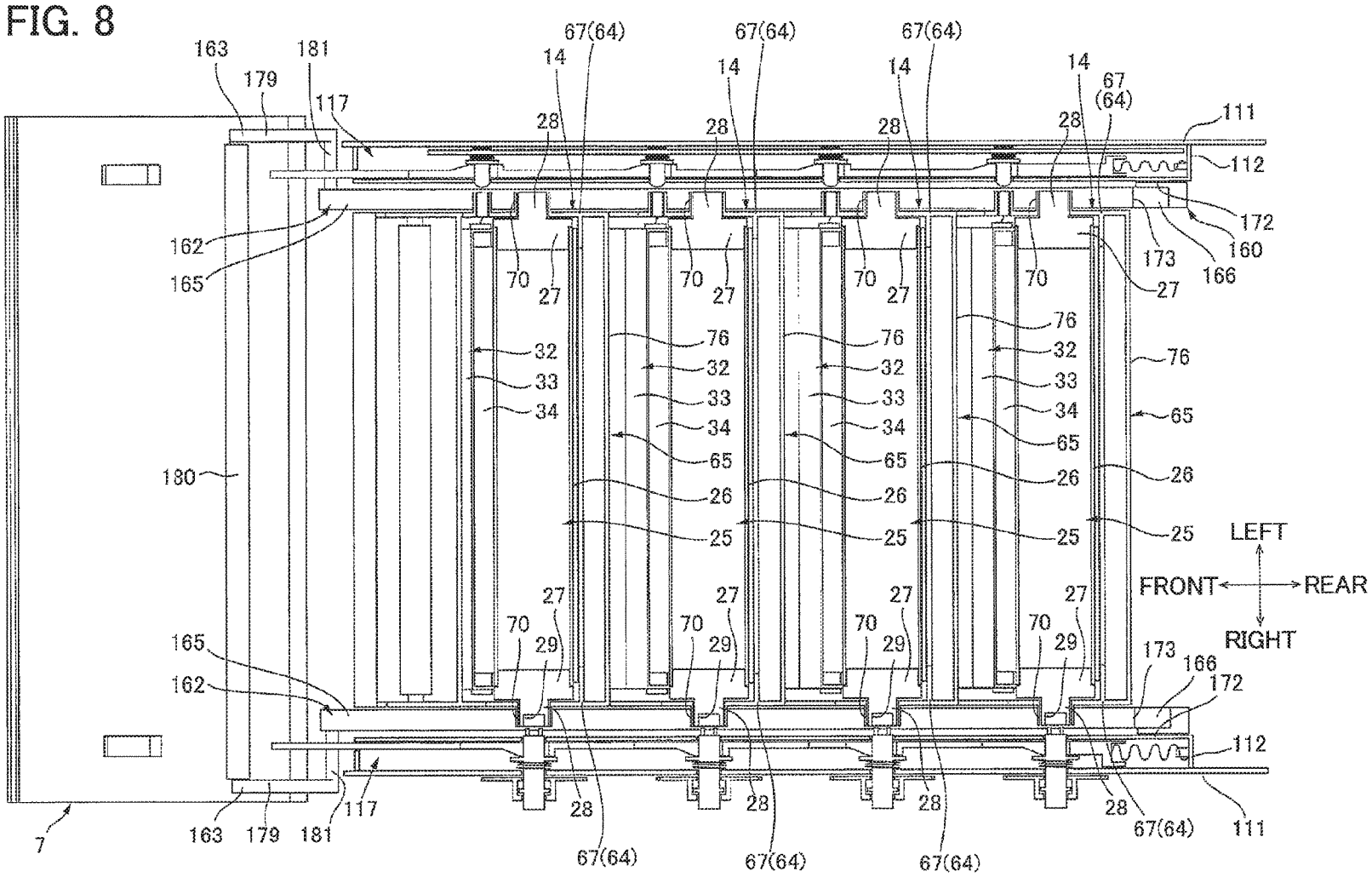
FIG. 8 is a cross-sectional view taken along a line D-D of FIG. 6.

Following describes detachment operation of process cartridge 14. In order to detach the process cartridge 14 from the body casing 2, the front cover 7 is firstly displaced to the opening position from the closing position as illustrated in FIG. 8.

Next, as illustrated in FIG. 6, the gripping portions 180 of the connection portions 163 of the pivot portion 160 are pivoted in the counter-clockwise direction in the right view about the insertion portions 181 so as to be separated from the hook-shaped portions 122.

Then, when the engagement between the connection portions 163 and the hook-shaped portions 122 is released, the moving arms 162 pivot about the pivot shafts 172 in the counter-clockwise direction in the right view to move to the non-pressing position.

Accordingly, the upward pressure on the four process cartridges 14 exerted by the moving arms 162 is released, and the four process cartridges 14 are then positioned in the release position. Accordingly, the photosensitive drums 25 and the positioning concave portions 121 are disengaged.

In this way, the process cartridges 14 are supported by the drawer 16 as the bottom walls 68 contact the support surfaces 94 of the concave portions 88.

Following describes the movement of the drawer 16 from the internal position toward the external position.

First, in order to operate the movement of the drawer 16, the stopper 90 of the drawer 16 is firstly rotated to the non-regulation position as indicated by the dashed line of FIG. 2. Accordingly, the engagement between the insertion portion 97 and the engagement portion 186 is released.

Next, the drawer 16 is drawn forward through the opening 20 as illustrated in FIG. 9. In other words, the drawer 16 is drawn forward so as to be separated from the pivot shaft 172 of the moving arm 162.

Consequently, both end portions of the drawer 16 in the leftward/rightward direction are guided by the first guide grooves 188, and the lower surface of the drawer 16 is guided forward by the rotated rollers 190.

The rollers 89 of the drawer 16 are disposed inside the second guide grooves 189, so that the drawer 16 is guided by the rollers 89.

In accordance with the above-described procedure, the drawer 16 slides forward to the external position.

Accordingly, the process cartridges 14 are attachable to and detachable from the drawer 16 as indicated by the imaginary lines of FIG. 9.

7. Attachment Operation of Process Cartridge

In order to attach the process cartridge 14 to the body casing 2 in the attachment operation, the above-described procedure needs to be performed in the reverse order.

Specifically, as illustrated in FIG. 9, the process cartridges 14 are placed on the support surfaces 94 of the corresponding concave portions 88 of the drawer 16.

Then, the drawer 16 supporting the four process cartridges 14 attached thereto is slid backward through the opening 20 to the internal position. In other words, the drawer 16 is pressed backward, such that the rotation shafts 172 of the pair of moving arms 162 are closer to the drawer 16.

Next, the stopper 90 of the drawer 16 is moved to the regulation position as indicated by the solid lines in FIG. 2. Accordingly, the insertion portion 97 of the stopper 90 engages with the engagement portion 186.

Then, as illustrated in FIG. 3, the moving arms 162 of the pivot portion 160 are pivoted in the clockwise direction in the right view about the pivot shaft 172, and the connection portions 163 of the pivot portion 160 are pivoted about the insertion portions 181 so that the gripping portions 180 of the connection portions 163 engage with the hook-shaped portions 122.

Accordingly, the moving arms 162 are positioned to the pressing position and the four process cartridges 14 are positioned to the engagement position.

Next, as illustrated in FIG. 5, the front cover 7 is moved from the opening position to the closing position.

With the above-described procedure, the attachment of the process cartridges 14 to the body casing 2 is completed.

8. Operation and Effect (1) According to the printer 1, as illustrated in FIG. 3, the moving arm 162 is rotatable about the pivot shaft 172 at the rear end portion between the pressing position and the non-pressing position.

For that reason, since the pivot center of the moving arm 162 does not move, the four process cartridges 14 can be reliably moved upward.

As a result, the photosensitive drum 25 can reliably engage with the positioning member 114 and the four process cartridges 14 can be located at the engagement position altogether.

Further, since the front end portion of the moving arm 162 is operated via the opening 20, which is disposed at the front side of the body casing 2 so that the inside and the outside of the body casing 2 communicate with each other, the process cartridge 14 disposed at the foremost side can be reliably pressed toward the engagement position.

Further, since the moving arm 162 is operated from the front side so as to pivot about the pivot shaft 172 located at the rear end portion of the moving arm 162, the process cartridge 14 disposed at the backmost side can be reliably pressed toward the engagement position.

As a result, when the four process cartridges 14 disposed in parallel are pressed by the pair of moving arms 162 from the release position toward the engagement position, the flanges 27 of the photosensitive drum 25 in the rearmost process cartridge 14, which is farthest from the opening 20, can reliably engage with the positioning concave portion 121 of the positioning member 114. Meanwhile, the flanges 27 of the photosensitive drum 25 in the foremost process cartridge 14 can engage with the positioning concave portions 121 of the positioning member 114.

Further, the moving arm 162 in the vicinity of the pressing position is pivotally moved substantially in the same direction as the movement of the four process cartridges 14, which are moved toward the engagement position. That is, the moving arms 162 can move upward. Accordingly, the four process cartridges 14 can be straightly moved toward the engagement position.

(2) Further, according to the printer 1, as illustrated in FIGS. 3 and 6, the moving arm 162 can move the four process cartridges 14 between the engagement position and the release position.

(3) Further, according to the printer 1, as illustrated in FIGS. 3 and 6, the moving arm 162 moves the body portion 165 and the base portion 166 in the interlocking relation, when the moving arm 162 are pivoted about the pivot shaft 172.

As a result, the moving arm 162 can be stably rotated.

(4) Further, according to the printer 1, as illustrated in FIGS. 3 and 4, each of the four process cartridges 14 can be urged toward the engagement position by the urging member 167 in the moving arm 162 while the moving arm 162 is pivoted so as to press the four process cartridges 14 toward the engagement position.

For that reason, the flanges 27 of each of the photosensitive drums 25 in the four process cartridges 14 can more reliably engage with the positioning concave portions 121 of the positioning members 114.

(5) Further, according to the printer 1, as illustrated in FIGS. 3 and 4, each of the four process cartridges 14 can be urged toward the engagement position by the urging member 167. Meanwhile, the moving arm 162 can pivot so as to press the four process cartridges 14 toward the engagement position.

(6) Further, according to the printer 1, as illustrated in FIGS. 3 and 4, the flanges 27 of the photosensitive drum 25 can more reliably engage with the positioning concave portions 121 of the positioning members 114 by the urging force of the spring 176 urging the backing plate 175.

(7) Further, according to the printer 1, as illustrated in FIGS. 3 and 6, the moving arm 162 can be pivoted in the range of 3 degrees to 10 degrees so as to be shifted between the pressing position and the non-pressing position.

(8) Further, according to the printer 1, as illustrated in FIG. 6, the vertical distances between the four photosensitive drums 25 and the corresponding urging members 167 are different from each other, when the moving arm 162 is in the non-pressing position. However, since the moving arm 162 can pivot about the pivot shaft 172 of the rear end portion as illustrated in FIGS. 3 and 6, the four photosensitive drums 25 can be urged altogether.

(9) Further, according to the printer 1, as illustrated in FIGS. 3 and 4, since the spring 176 is stored in the storage portion 169, the photosensitive drum 25 can be stably urged by the spring 176.

(10) Further, according to the printer 1, as illustrated in FIG. 3, the extension direction of the base portion 166 of the moving arm 162 intersects the extension direction of the body portion 165, and the rigidity of the moving arm 162 can be improved by the curved portion 173, which connects the body portion 165 and the base portion 166.

(11) Further, according to the printer 1, as illustrated in FIGS. 3 and 6, the moving arm 162 can be easily pivoted by the operation of the gripping portion 180 of the connection portion 163.

(12) Further, according to the printer 1, as illustrated in FIGS. 3 and 6, since the extension direction of the gripping portion 180 in the connection portion 163 intersects the extension direction of the body portion 165 in the moving arm 162, the gripping portion 180 can be easily gripped.

As a result, the moving arm 162 can be easily rotated by the operation of the gripping portion 180.

(13) Further, according to the printer 1, as illustrated in FIGS. 1 and 9, since the drawer 16 is moved between the internal position inside the body casing 2 and the external position outside the body casing 2, the four process cartridges 14 can be moved to the inside and the outside of the body casing 2 altogether.

As a result, each flange 27 of the photosensitive drums 25 of the four process cartridges 14 can engage with the positioning concave portion 121 of the positioning member 114. Further, the four process cartridges 14 are efficiently moved to the inside and the outside of the body casing 2.

Further, the drawer 16 can be moved through the opening 20 which is formed on the front end portion of the body casing 2 so that the inside and the outside of the body casing 2 communicate with each other.

(14) Further, according to the printer 1, as illustrated in FIGS. 6 and 9, when the drawer 16 moves from the internal position to the external position, the drawer 16 moves away from the pivot shaft 172 of the moving arm 162. When the drawer moves from the external position to the internal position, the drawer moves toward the pivot shaft 172 of the moving arm 162. For this reason, the drawer 16 can be moved between the internal position and the external position without contacting the pivot shaft 172.

(15) Further, according to the printer 1, as illustrated in FIGS. 6 and 9, since the pivot shaft 172 of the moving arm 162 is disposed in the vicinity of the second wall 2B opposite to the first wall 2A forming the opening 20 through which the drawer 16 can be passed, the drawer 16 can be reliably moved between the internal position and the external position without contacting the pivot shaft 172.

Further, when the gripping portion 180 of the connection portion 163 is operated via the opening 20 through which the drawer 16 passes, the four process cartridges 14 can be reliably pressed toward the engagement position altogether. That is, when the end portion opposite to the pivot shaft 172 of the moving arm 162 is operated via the opening 20, the four process cartridges 14 can be reliably pressed toward the engagement position altogether.

As a result, when the four process cartridges 14 are pressed from the release position toward the engagement position by the moving arm 162, the flanges 27 of the photosensitive drum 25 can reliably engage with the positioning concave portions 121.

(16) Further, according to the printer 1, as illustrated in FIGS. 1 and 3, since the pivot shaft 172 of the moving arm 162 is disposed in the vicinity of the second wall 2B disposed rearward of the backmost process cartridge 14, the contact of the process cartridge 14 with respect to the pivot shaft 172 can be suppressed.

(17) Further, according to the printer 1, as illustrated in FIG. 2, since the drawer 16 has a flat plate shape so as to be disposed on the same plane extending in both the leftward/rightward direction and the frontward/rearward direction, the drawer 16 can be decreased in size.

For that reason, the movement space of the moving arm 162 inside the body casing 2 can be sufficiently provided.

(18) Further, according to the printer 1, as illustrated in FIGS. 1 and 3, since the vertical dimension of the drawer 16 is from 5 percent to 30 percent of the vertical dimension of the process cartridge 14, the dimension of the drawer 16 supporting the process cartridge 14 can be reduced.

(19) Further, according to the printer 1, as illustrated in FIGS. 4 and 7, since the moving arm 162 and the drawer 16 can be positioned so as to overlap with each other when viewed in the upward/downward direction, the space inside the body casing 2 can be saved while providing the movement space of the moving arm 162.

(20) Further, according to the printer 1, as illustrated in FIGS. 4 and 7, the moving arm 162 can be disposed between the side wall 67 of each of the four process cartridges 14 arranged in the frontward/rearward direction and the side wall 111 of the body casing 2.

For that reason, the moving arm 162 can be efficiently disposed inside the body casing 2.

(21) Further, according to the printer 1, as illustrated in FIGS. 4 and 7, since the drawer 16 is closer to the side wall 111 of the body casing 2 than the moving arm 162 is, the moving arm 162 can be efficiently disposed while ensuring the size of the drawer 16.

(22) Further, according to the printer 1, as illustrated in FIGS. 4 and 7, the flange 27 of the photosensitive drum 25 can be supported by the flange support portion 70 of the side wall 67.

Then, the process cartridge 14 can be located at the engagement position when the flange support portion 70 is pressed by the moving arm 162, while the flange 27 of the photosensitive drum 25 is protected by the flange support portion 70.

(23) Further, according to the printer 1, as illustrated in FIGS. 3 and 4, the flange 27 can engage with the positioning concave portion 121 with a simple configuration in which the flange 27 of the photosensitive drum 25 is fitted to the positioning concave portion 121.

(24) Further, according to the printer 1, as illustrated in FIGS. 3 and 4, since the positioning concave portion 121 is recessed away from the photosensitive drum 25, the photosensitive drum 25 can be easily received.

9. Second Embodiment

Figure 10:
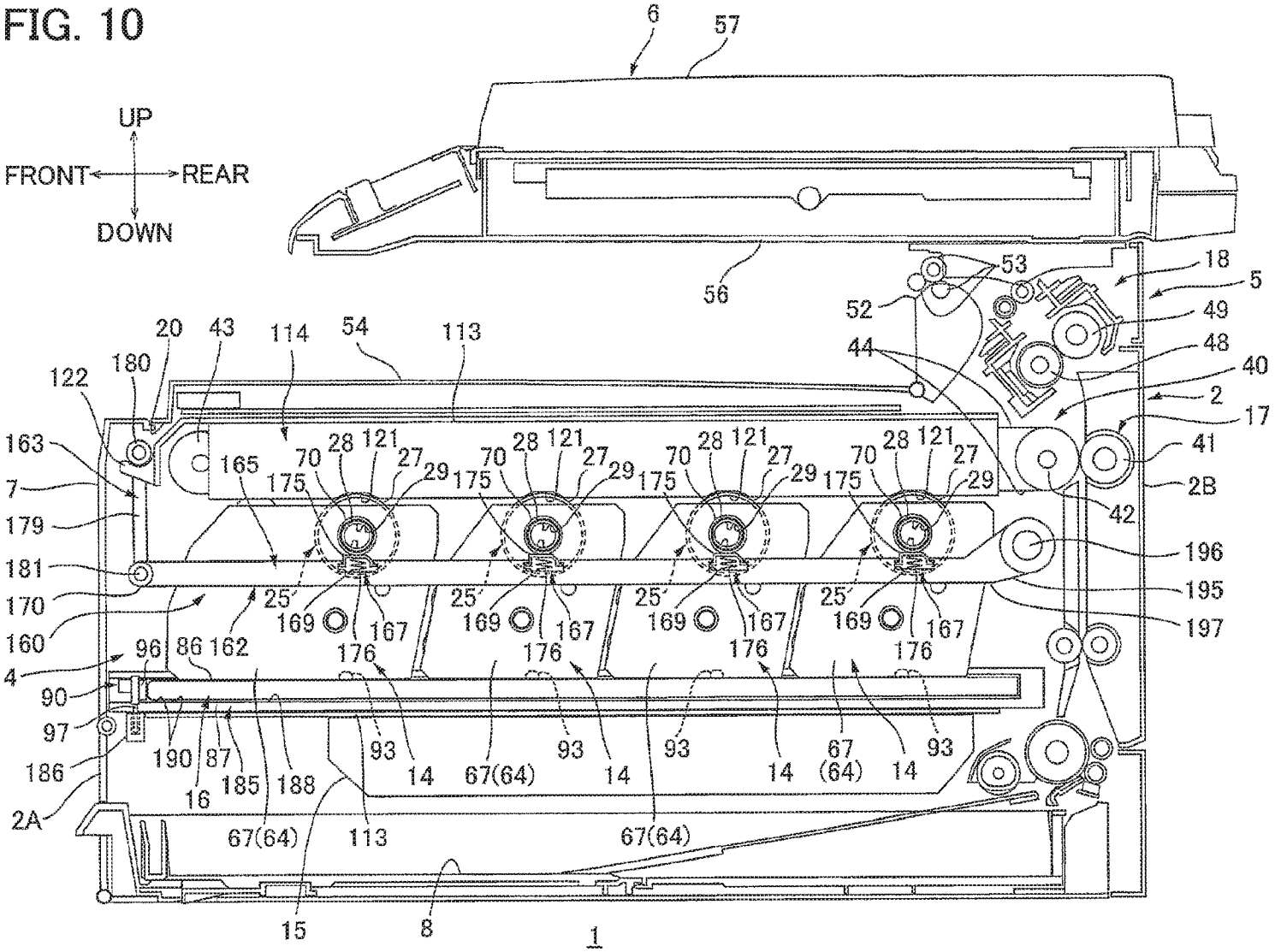
FIG. 10 is a cross-sectional view of a printer according to a second embodiment, and taken along a plane positioned rightward of a moving arm.

Referring to FIG. 10, a second embodiment of the image forming apparatus will be described, wherein like parts and components are designated by the same reference numerals and characters as those shown in the first embodiment.

In the printer 1 of the first embodiment, as illustrated in FIG. 3, the base portions 166 of the moving arms 162 extend downward from the rear end portion of the body portions 165.

On the contrary, in the printer 1 of the second embodiment of the invention, as illustrated in FIG. 10, the base portions 195 of the moving arms 162 extend upward from the rear end portions of the body portions 165. That is, the base portion 195 extends in a direction intersecting the body portion 165. The base portion 195 has a substantially prismatic shape. Each base portion 195 includes a rotation shaft 196.

The rotation shaft 196 has a substantially columnar shape which protrudes outward from the outer surface of the rear upper end portion of the base portion 195 in the leftward/rightward direction, and is disposed inside the storage space 117 while penetrating the frame 112 although not illustrated in the drawings.

Accordingly, the moving arm 162 is pivotable about the rotation shaft 196 located at the rear upper end portion of the base portion 195.

In this case, a portion connecting the body portion 165 and the base portion 195 is a curved portion 197. The curved portion 197 is located between the backmost storage portion 169 and the rotation shaft 196. The curved portion 197 has a bending portion whose bend angle is 18 degrees with respect to the moving arm 162.

Even in the second embodiment, the same operation and effect as those of the first embodiment can be obtained.

10. Third Embodiment

Figure 11:
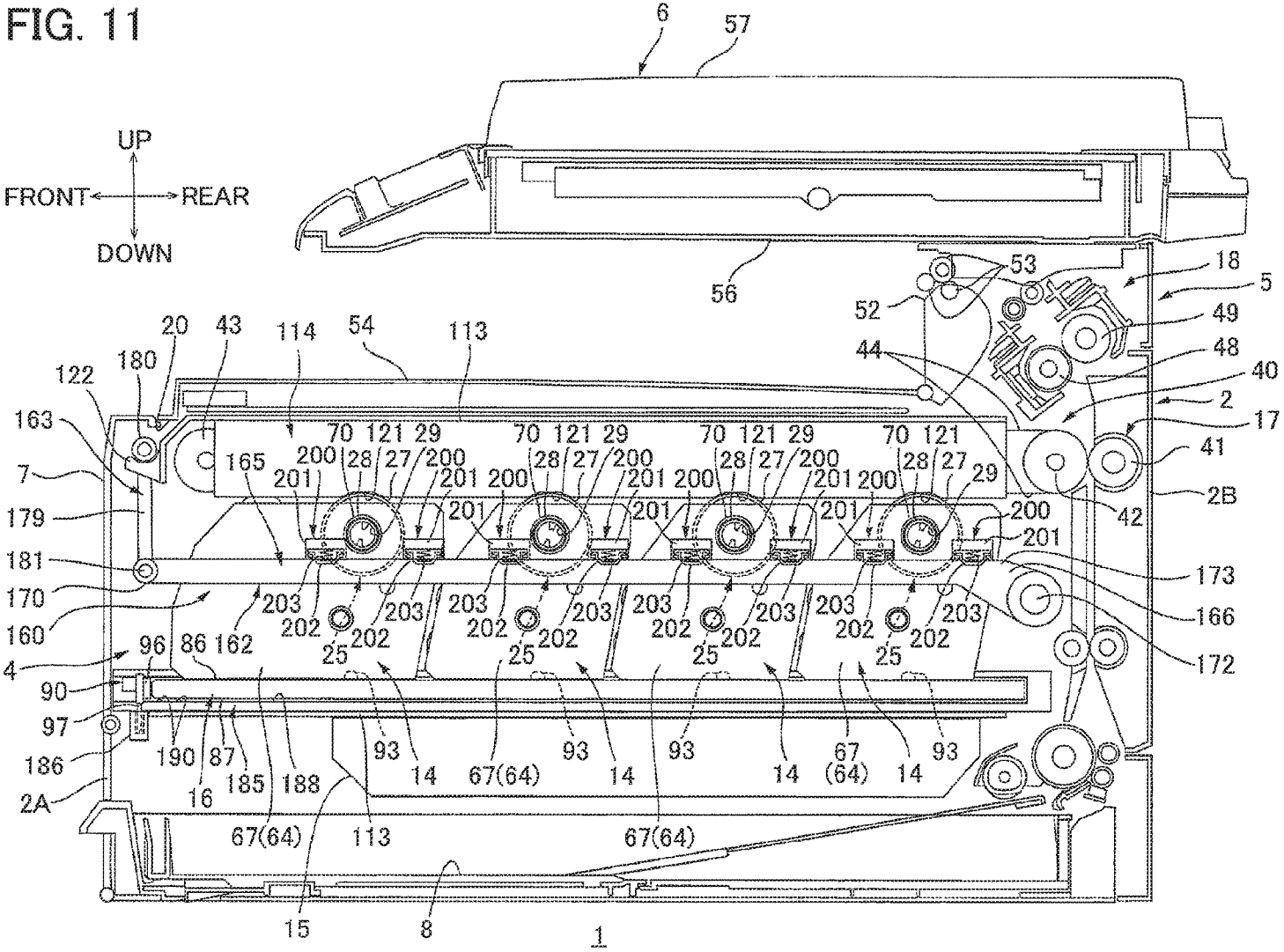
FIG. 11 is a cross-sectional view of a printer according to a third embodiment, and taken along a plane positioned rightward of a moving arm.

Referring to FIG. 11, a third embodiment of the image forming apparatus of the invention will be described, wherein like parts and components are designated by the same reference numerals and characters as those shown in the first embodiment.

In the printer 1 according to the first embodiment, as illustrated in FIGS. 3 and 4, the urging members 167 are provided in the moving arms 162.

On the contrary, in the printer 1 according to the third embodiment, as illustrated in FIG. 11, the moving arm 162 does not include the urging members 167, and each process cartridge 14 includes four urging members 200 instead.

Two left urging members 200 of the four urging members 200 are separated from each other in the frontward/rearward direction while sandwiching the left flange support portion 70 of the process cartridge 14. Further, two right urging members 200 from among the four urging members 200 are separated from each other in the frontward/rearward direction while sandwiching the right flange support portion 70 of the process cartridge 14.

The urging member 200 includes a spring support portion 201, a backing plate 202, and a spring 203.

The spring support portion 201 protrudes outward in the leftward/rightward direction from the outer surface of the side wall 67 of the process cartridge 14 in the leftward/rightward direction. The spring support portion 201 has a prismatic shape and has a U-shape forming a lower open end in the side view.

The backing plate 202 is vertically movable inside the spring support portion 201. The backing plate 202 has a plate shape forming a U-shape whose center portion in the frontward/rearward direction protrudes downward in the side sectional view.

The spring 203 has a steel wire wound in a coil shape and in a spiral shape extending in the upward/downward direction. The spring 203 is disposed in a compressed state inside the spring support portion 201 so that the lower end thereof contacts the backing plate 202 and the upper end thereof contacts the inner surface of the spring support portion 201. Accordingly, the spring 203 constantly urges the backing plate 202 downward.

The backing plates 202 of the urging members 200 contact the upper surfaces of the moving arms 162 when the pair of moving arms 162 is in the pressing position, in which the process cartridges 14 are pressed toward the engagement position.

Accordingly, the process cartridges 14 are urged upward by the urging force of the springs 203 of the urging members 200.

According to the third embodiment, the pair of moving arms 162 can be pivoted so that the four process cartridges 14 are pressed toward the engagement position. Meanwhile, the four process cartridges 14 can be urged toward the engagement position by the urging members 200 provided in the process cartridges 14.

Further, since the two urging members 200 are disposed so as to sandwich the flange support portion 70, the process cartridge 14 can be stably urged toward the engagement position.

For that reason, each flange 27 of the photosensitive drums 25 of the four process cartridges 14 can reliably engage with the positioning concave portion 121 of the positioning member 114.

Further, the process cartridges 14 can be reliably located at the engagement position by the urging force of the springs 203 urging the backing plates 202.

Further, since the spring 203 urging the backing plate 202 is supported by the spring support portion 201, the process cartridge 14 can be stably urged by the spring 203.

Further, even in the third embodiment, the same operation and effect as those of the first embodiment can be obtained.

11. Fourth Embodiment

Figure 12:
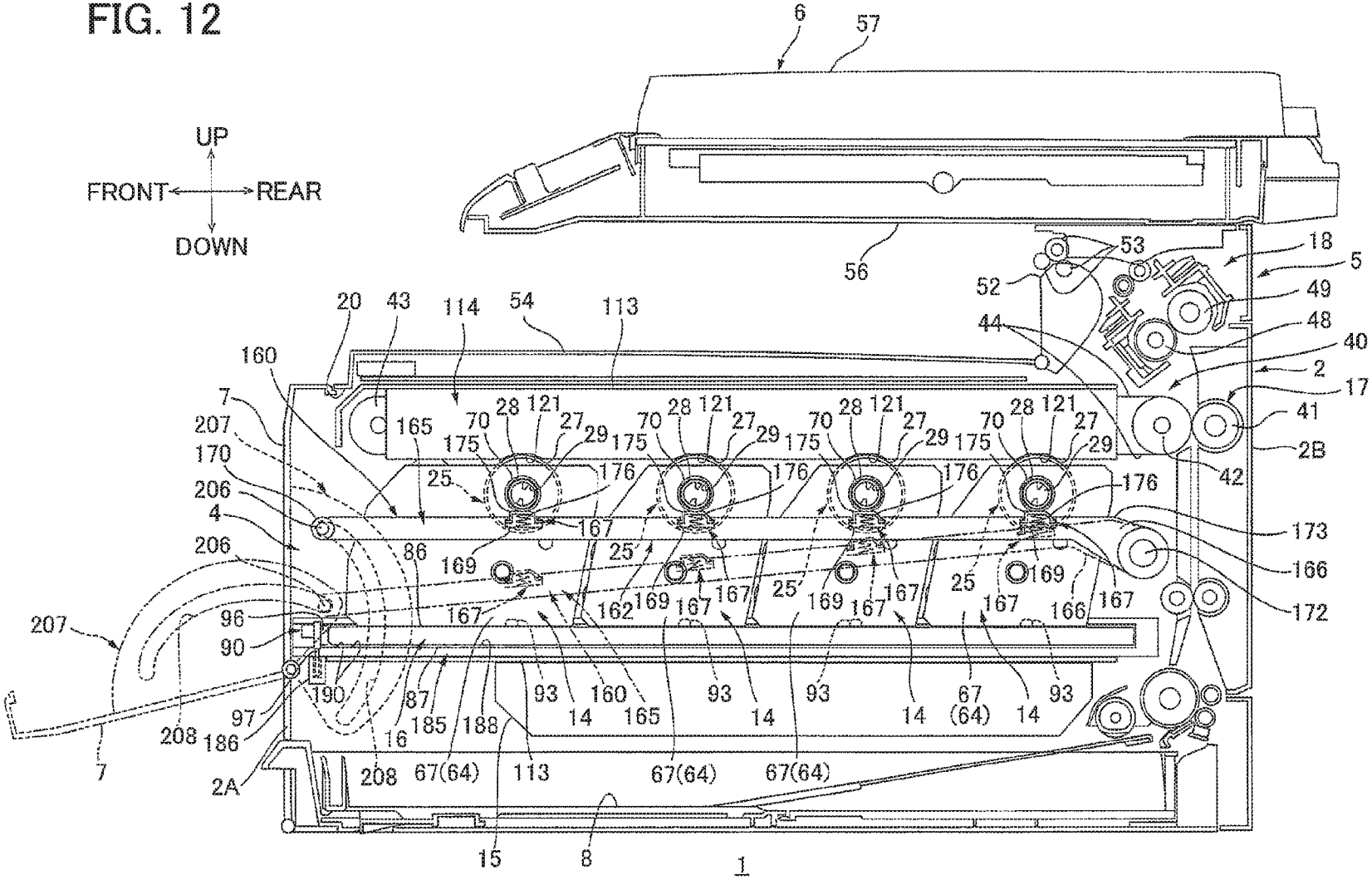
FIG. 12 is a cross-sectional view of a printer according to a fourth embodiment, and taken along a plane positioned rightward of a moving arm.

Referring to FIG. 12, a fourth embodiment of the image forming apparatus of the invention will be described, wherein like parts and components are designated by the same reference numerals and characters as those shown in the first embodiment.

In the printer 1 according to the first embodiment, as illustrated in FIGS. 3 and 6, the pair of moving arms 162 is connected to the connection portions 163. Then, the pair of moving arms 162 is pivoted by the operation of the connection portions 163 after the front cover 7 is displaced to the opening position.

On the contrary, in the printer 1 according to the fourth embodiment, as illustrated in FIG. 12, the pivot portion 160 does not include the connection portions 163, and includes a pair of link shafts 206 instead. Further, the front cover 7 includes a pair of semi-circular disks 207. In addition, in the description of the fourth embodiment, a description will be made on the basis of the state where the front cover 7 is in the closing position, as indicated in FIG. 12.

Each link shaft 206 has a substantially columnar shape extending in the leftward/rightward direction. The link shaft 206 is inserted into the hole 170 of the moving arm 162 and extends from the hole 170 outward in the leftward/rightward direction.

The semi-circular disks 207 are separated from each other in the leftward/rightward direction. The gap of the pair of semi-circular disks 207 in the leftward/rightward direction is larger than the gap of the pair of moving arms 162 in the leftward/rightward direction. The semi-circular disk 207 has a substantially semi-circular plate shape in the side view so as to extend backward from the rear surface of the front cover 7. The semi-circular disk 207 includes a curved groove 208.

The curved groove 208 is formed at a radially inward position with respect to the peripheral edge of the semi-circular disk 207. The curved groove 208 penetrates the semi-circular disk 207 in the leftward/rightward direction. The curved groove 208 is curved so that the distance from the pivotal center of the front cover 7 decreases in the downward direction. The curved groove 208 has an upper end portion. The upper end portion of the curved groove 208 receives and engages with the left or right outer end portion of the link shaft 206, when the front cover 7 is in the closing position.

When the front cover 7 is moved to the opening position from the closing position, the semi-circular disks 207 move forward and downward.

In conjunction with the movement of the front cover 7, the link shafts 206 moves along the curved grooves 208 so as to be closer to the pivotal center of the front cover 7.

Accordingly, the link shafts 206 move downward and the moving arms 162 pivot in the counter-clockwise direction in the right side view about the pivot shafts 172. As a result, the contact between the urging members 167 and the flange support portions 70 of the process cartridges 14 is released.

In this way, the pair of moving arms 162 can be moved between the closing position and the opening position in the interlocking relation with the opening/closing operation of the front cover 7.

Even in the fourth embodiment, the same operation and effect as those of the first embodiment can be obtained.

What is claimed is:

1. An image forming apparatus comprising:

a body casing including a positioning member;

a first process cartridge including a first photosensitive drum;

a second process cartridge including a second photosensitive drum; and a moving arm pivotally movable between a pressing position and a non-pressing position about a pivot axis, the moving arm including:

a first urging member urging the first process cartridge to the positioning member in a state where the moving arm is positioned in the pressing position so that the first photosensitive drum is engaged with the positioning member, the first urging member moving from a first position to a second position when the moving arm moves from the non-pressing position to the pressing position, the second position being closer to the positioning member than the first position is to the positioning member; and a second urging member positioned between the pivot axis and the first urging member, the second urging member urging the second process cartridge to the positioning member in the state where the moving arm is positioned in the pressing position so that the second photosensitive drum is engaged with the positioning member, the second urging member moving from a third position to a fourth position when the moving arm moves from the non-pressing position to the pressing position, the fourth position being closer to the positioning member than the third position is to the positioning member, wherein a distance between the first position and the second position is larger than a distance between the third position and the fourth position.

2. The image forming apparatus according to claim 1, wherein the moving arm includes:

a base portion including a pivot shaft defining the pivot axis; and a body portion including one end and another end opposite from the one end, the other end being connected to the base portion, the first urging member and the second urging member being positioned between the one end of the body portion and the other end of the body portion.

3. The image forming apparatus according to claim 1, wherein first urging member includes a first spring.

4. The image forming apparatus according to claim 1, wherein the second urging member includes a second spring.

5. The image forming apparatus according to claim 1, wherein the moving arm is pivotally movable between the pressing position and the non-pressing position within an angle ranging from 3 degrees to 10 degrees with respect to the pivot axis.

6. The image forming apparatus according to claim 2, wherein the body portion comprises:

a first storage portion recessed away from the first photosensitive drum; and a second storage portion recessed away from the second photosensitive drum, wherein the first storage portion stores the first urging member and the second storage portion stores the second urging member.

7. The image forming apparatus according to claim 1, further comprising a drawer configured to support the first process cartridge and the second process cartridge, the drawer being movable between an internal position inside of the body casing and an external position outside of the body casing.

8. The image forming apparatus according to claim 7, wherein the drawer moves away from the pivot axis when the drawer moves from the internal position to the external position.

9. The image forming apparatus according to claim 8, wherein the body casing has a first wall formed with an opening and a second wall opposite from the first wall, the drawer being movable between the internal position and the external position through the opening; and wherein the pivot axis is closer to the second wall of the body casing than the pivot axis is to the first wall of the body casing.

10. The image forming apparatus according to claim 9, wherein the pivot axis is closer to the second wall of the body casing than the second process cartridge is to the second wall of the body casing.

11. The image forming apparatus according to claim 7, wherein the drawer has a plate shape.

12. The image forming apparatus according to claim 11, wherein the drawer has a drawer dimension in a vertical direction, the first process cartridge has a cartridge dimension in the vertical direction, and the drawer dimension ranges from 5 percent to 30 percent of the cartridge dimension.

13. The image forming apparatus according to claim 12, wherein the moving arm overlaps with the drawer when viewed in the vertical direction.

14. The image forming apparatus according to claim 7, wherein the body casing includes a first side wall and a second side wall facing the first side wall in a direction along the pivot axis of the moving arm; and wherein the first process cartridge includes a side wall facing the first side wall of the body casing, the side wall of the first process cartridge supporting the first photosensitive drum, and the moving arm being positioned between the first side wall of the body casing and the side wall of the first process cartridge.

15. The image forming apparatus according to claim 14, wherein a gap between the moving arm and the first side wall of the body casing in the direction along the pivot axis of the moving arm is greater than a gap between the drawer and the first side wall of the body casing in the direction along the pivot axis of the moving arm.

16. The image forming apparatus according to claim 14, wherein the first photosensitive drum includes:

a drum body having a photosensitive layer and a drum end portion; and a flange disposed on the drum end portion of the drum body;

wherein the side wall of the first process cartridge includes a flange support portion supporting the flange, the flange support portion protruding toward the first side wall of the body casing; and wherein the moving arm presses the flange support portion to the positioning member in a state where the moving arm is positioned in the pressing position.

17. The image forming apparatus according to claim 7, wherein the body casing is formed with an opening, the drawer being movable between the internal position and the external position through the opening, the body casing including a cover movable between a closing position to close the opening and an opening position to open the opening; and wherein the moving arm moves from the non-pressing position to the pressing position when the cover moves from opening position to the closing position.

18. The image forming apparatus according to claim 16, wherein the positioning member has a concave portion configured to receive the flange of the first photosensitive drum.

19. The image forming apparatus according to claim 1, wherein the positioning member has a concave portion recessed away from the first photosensitive drum.

* * * * *